US010975699B2

(12) United States Patent
Meinig et al.

(10) Patent No.: US 10,975,699 B2
(45) Date of Patent: Apr. 13, 2021

(54) HYDRAULIC DEVICE COMPRISING A SEALING ELEMENT

(71) Applicant: Schwäbische Hüttenwerke Automotive GmbH, Aalen-Wasseralfingen (DE)

(72) Inventors: Uwe Meinig, Bad Saulgau (DE); Dominik Baur, Scheer (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 0 days.

(21) Appl. No.: 15/837,473

(22) Filed: Dec. 11, 2017

(65) Prior Publication Data

US 2018/0163542 A1 Jun. 14, 2018

(30) Foreign Application Priority Data

Dec. 12, 2016 (DE) ..... 10 2016 124 104.0

(51) Int. Cl.
*F01L 1/344* (2006.01)
*F01C 19/12* (2006.01)
(Continued)

(52) U.S. Cl.
CPC ..... *F01C 19/12* (2013.01); *F01C 1/344* (2013.01); *F01L 1/3442* (2013.01);
(Continued)

(58) Field of Classification Search
CPC . F01L 1/3442; F01L 2001/34479; F01L 1/46; F04C 15/0015; F04C 14/18
(Continued)

(56) References Cited

U.S. PATENT DOCUMENTS 3,915,600 A 10/1975 Lamm
6,032,626 A * 3/2000 Haag ..... F01L 1/3442 123/90.17
(Continued)

FOREIGN PATENT DOCUMENTS

CN 102191963 A 9/2011
CN 102597436 A 7/2012
(Continued)

OTHER PUBLICATIONS

Chinese Office Action for Application No. 201711319449.4, dated Nov. 29, 2018, 18 pages.
(Continued)

*Primary Examiner* — Jorge L Leon, Jr.
(74) *Attorney, Agent, or Firm* — RatnerPrestia

(57) ABSTRACT

A hydraulic device for an internal combustion engine or a gearing system, the hydraulic device including a housing featuring a chamber wall structure which delineates a pressure chamber for a pressurised hydraulic fluid; an actuating member which can be adjusted in the housing relative to the chamber wall structure in an actuating direction and in an actuating counter direction opposite to the actuating direction in order to adjust the delivery volume or phase position; and a sealing element including a sealing structure and a spring structure which is supported or moulded on one of the chamber wall structure and the actuating member, preferably the actuating member, and presses the sealing structure into sealing contact with the other of the chamber wall structure and the actuating member with a spring force in order to seal off the pressure chamber. The sealing structure and the spring structure are moulded in one piece.

19 Claims, 16 Drawing Sheets

(51) Int. Cl.

| | |
|---|---|
| ***F04C 15/00*** | (2006.01) |
| ***F01C 1/344*** | (2006.01) |
| *F01L 1/047* | (2006.01) |
| *F04C 14/18* | (2006.01) |

(52) U.S. Cl.
CPC ..... *F04C 15/0015* (2013.01); *F01L 1/047* (2013.01); *F01L 2001/34479* (2013.01); *F04C 14/18* (2013.01)

(58) Field of Classification Search
USPC ..... 123/90.15, 90.17, 90.37
See application file for complete search history.

(56) References Cited

U.S. PATENT DOCUMENTS

| | | | | |
|---|---|---|---|---|
| 6,173,688 | B1 | 1/2001 | Fukuhara et al. | |
| 6,237,466 | B1 * | 5/2001 | Fukuhara | F01L 1/3442 92/125 |
| 8,814,544 | B2 | 8/2014 | Ebinger et al. | |
| 8,826,872 | B2 | 9/2014 | Noguchi et al. | |
| 9,534,598 | B2 | 1/2017 | Mauser et al. | |
| 10,072,538 | B2 | 9/2018 | Welte et al. | |
| 2001/0017117 | A1 * | 8/2001 | Golbach | F01L 1/3442 123/90.16 |
| 2002/0139334 | A1 * | 10/2002 | Kinugawa | F01L 1/34 123/90.17 |
| 2005/0191171 | A1 | 9/2005 | Lehmann et al. | |
| 2007/0113811 | A1 | 5/2007 | Grunow et al. | |
| 2008/0141962 | A1 * | 6/2008 | Borraccia | F01L 1/3442 123/90.17 |
| 2009/0038569 | A1 * | 2/2009 | Weber | F01L 1/3442 123/90.17 |
| 2009/0044770 | A1 * | 2/2009 | Scott | F01L 1/3442 123/90.17 |
| 2009/0045587 | A1 * | 2/2009 | DeAngelis | F01L 1/3442 277/500 |
| 2011/0085921 | A1 * | 4/2011 | Kato | F01M 1/12 417/213 |
| 2011/0220046 | A1 | 9/2011 | Welte et al. | |
| 2012/0139185 | A1 * | 6/2012 | Tomura | F01L 1/3442 277/345 |
| 2012/0216766 | A1 * | 8/2012 | Noguchi | F16J 15/525 123/90.16 |
| 2013/0121867 | A1 | 5/2013 | Ebinger et al. | |
| 2013/0216417 | A1 | 8/2013 | Dixon et al. | |
| 2014/0341768 | A1 | 11/2014 | Mauser et al. | |
| 2015/0285248 | A1 | 10/2015 | Dixon et al. | |
| 2016/0010643 | A1 * | 1/2016 | Hayes-Pankhurst | F01C 5/04 418/139 |

FOREIGN PATENT DOCUMENTS

| | | | | |
|---|---|---|---|---|
| CN | 103104484 | A | | 5/2013 |
| CN | 105074217 | A | | 11/2015 |
| CN | 104024578 | B | | 3/2017 |
| DE | 2350572 | A1 | | 4/1975 |
| DE | 10237414 | A1 | | 3/2004 |
| DE | 10242765 | A1 | | 3/2004 |
| DE | 10353027 | A1 | | 6/2005 |
| DE | 102004025246 | A1 | | 12/2005 |
| DE | 102011086175 | B3 | | 5/2013 |
| EP | 0974738 | A2 | | 1/2000 |
| EP | 2365193 | A1 | | 9/2011 |
| JP | 2000265814 | A | | 9/2000 |
| JP | 2000265814 | A | * | 9/2000 |
| JP | 2001182511 | A | | 7/2001 |
| JP | 2001234713 | A | | 8/2001 |
| JP | 2005083264 | A | | 3/2005 |
| JP | 2005083272 | A | | 3/2005 |

OTHER PUBLICATIONS

European Search Report for European Application No. 17206837.1, dated May 15, 2018 with partial translation, 7 pages.
German Search Report issued in Application No. 10 2016 124 104.0 dated Sep. 18, 2017, 8 pages.
European Office Action for European Application No. 17 206 837.1, dated May 16, 2019, 4 pages.

* cited by examiner

HYDRAULIC DEVICE COMPRISING A SEALING ELEMENT

CROSS REFERENCE TO RELATED APPLICATIONS

This application claims priority to German Patent Application No. 10 2016 124 104.0, filed Dec. 12, 2016, the contents of such application being incorporated by reference herein.

FIELD OF THE INVENTION

The invention relates to a hydraulic device for an internal combustion engine or a gearing system. More specifically, the invention is directed to a sealing element of the hydraulic device, which serves to seal off a sealing gap which delineates a pressure chamber of the hydraulic device and is formed between a chamber wall structure and an actuating member which can be moved relative to the chamber wall structure. The hydraulic device is a hydraulic pump exhibiting an adjustable delivery volume, or a hydraulic cam shaft phase setter for adjusting the phase position of a cam shaft relative to a crankshaft of an internal combustion engine. The hydraulic device can be arranged in or on the internal combustion engine or a gearing system or can be designed to be arranged in or on an internal combustion engine or a gearing system. In addition to the hydraulic device, the invention also relates to a sealing element itself, which is designed to be installed in a hydraulic device of the type mentioned, and to the use of the sealing element for sealing off said sealing gap in a hydraulic device of the type mentioned.

BACKGROUND OF THE INVENTION

In adjustable hydraulic pumps—for example, lubricating oil pumps and gear pumps—of internal combustion engines and gearing systems, as well as in hydraulic cam shaft phase setters, functional components which can be moved hydraulically relative to each other have to be sealed from each other in order to seal off one or more pressure chambers. In cam shaft phase setters which are widely used today, which operate in accordance with the principle of a hydraulic pivoting motor, this relates above all to the sealing gaps which extend parallel to the rotational axis between the rotor and the stator. Usually, a sliding gap is formed by the rotor on an outer circumference and by the stator on an inner circumference which lies opposite the outer circumference of the rotor. Due to thermal expansion which occurs when the phase setter is in operation, and also due to manufacturing tolerances, a sufficient seal can often be achieved only with the aid of a sealing element which seals off the sliding gap. Comparable problems occur in hydraulic pumps which can be adjusted in terms of their delivery volume. Such pumps comprise an actuating member which can be adjusted back and forth in order to adjust the delivery volume and to which a hydraulic fluid can be applied in a pressure chamber. The pressure chamber is sealed off by means of a sealing element which is arranged between the actuating member and a chamber wall structure which delineates the pressure chamber. The sealing element reduces the leakage between the components of the cam shaft phase setter or hydraulic pump which are moved relative to each other and thus improves its effectiveness.

A cam shaft phase setter such as the invention relates to is known for example from EP 2 365 193 B1, which is incorporated by reference.

DE 10 2011 086 175 B3, which is incorporated by reference, discloses a hydraulic rotary pump comprising an actuating member which serves to adjust the delivery volume and to which a hydraulic fluid is applied in a pressure chamber. The actuating member, and a chamber wall structure which delineates the pressure chamber, form a sliding gap which is sealed off by a sealing element in the form of a beam-shaped sealing strip which is rigid in its own right. The sealing element is arranged in a cavity of the actuating member, and the hydraulic fluid is applied to the sealing element at a rear side in the cavity when the pump is in operation, thus pressing the sealing element into a sealing contact with the opposing chamber wall structure. A sufficient pressure of the hydraulic fluid ensures that the sealing gap is effectively sealed off. In operational states in which a sufficient hydraulic pressure is not yet available, for example when the pump is being started, this can cause an unintended and in particular undefined leakage across the sealing gap and therefore delayed suctioning by the pump. If the hydraulic fluid can be applied to the actuating member in each of the two directions in which it can be adjusted, a pressure difference across the sealing gap which changes direction can cause increased leakage with each change of direction.

In order to improve the sealing function of a sealing element, it is possible to provide—in addition to a sealing strip—a spring element which presses the sealing strip into the sealing contact. An arc-shaped leaf spring element made of spring steel, or a cylindrical segment made of an elastomer material, can for example be arranged, as the spring element, at the rear side of the sealing strip, in order to press the sealing strip into the sealing contact with a spring force. Using a separate spring element does however increase the costs incurred by the seal. In addition, the sealing strip and the spring element have to be positioned individually and correctly with respect to each other when fitted in series production and together pushed into a cavity which is typically provided on the actuating member. Aside from the higher manufacturing and fitting costs, a two-part sealing design also proves disadvantageous in comparison with an unmodified sealing element with regard to the error rate during fitting. A drop-in-pressure test may not detect that a spring element is incorrectly fitted or is missing. The plurality of parts also increases the likelihood that a spring element which is imperfectly fitted enters the pump or phase setter in the course of operations, causing malfunction or failure.

SUMMARY OF THE INVENTION

An aspect of the invention is an improved hydraulic device, specifically a hydraulic pump or cam shaft phase setter, in terms of sealing off a sealing gap of the type mentioned. The intention is to reduce the fitting complexity, increase the fitting reliability and where possible reduce the costs, in comparison with multi-part sealing devices.

The subject of the invention is a hydraulic device for an internal combustion engine or a gearing system, specifically a hydraulic pump exhibiting an adjustable delivery volume, or a hydraulic cam shaft phase setter for adjusting the phase position of a cam shaft relative to a crankshaft of an internal combustion engine. The hydraulic pump can in particular be a lubricating oil pump for supplying an internal combustion engine with lubricating oil, or a gear pump for supplying a gearing system with a hydraulic working medium or lubricating oil for lubricating the gearing system. The invention is preferably used in vehicle manufacturing, particularly preferably in road vehicles. The internal combustion engine can in particular be an engine for driving a motor vehicle. In embodiments as a gear pump, the hydraulic pump can also be used independently of an internal combustion engine and for example serve as a gear pump for a wind turbine or other device for generating energy.

The hydraulic device comprises: a housing featuring a chamber wall structure which delineates a pressure chamber for a pressurised hydraulic fluid, for example lubricating oil or a hydraulic working medium; and an adjustable actuating member which likewise delineates the pressure chamber. The chamber wall structure and the actuating member thus form wall regions which delineate the pressure chamber. The housing can be joined together from multiple moulded parts. A single moulded part which includes the chamber wall structure can also be interpreted as a housing. The chamber wall structure can be formed directly by the housing. It can however also be formed by a structure which is arranged in or on the housing and which in preferred embodiments cannot be moved relative to the housing, although in principle it can also be arranged such that it can be moved relative to the housing. The pressure chamber comprises an inlet and an outlet for the hydraulic fluid. In first embodiments, the inlet can also serve as the outlet, such that the hydraulic fluid flows into the pressure chamber through an opening which forms the inlet, in order to pressurise the pressure chamber or increase the pressure, and flows off through the same opening, which then forms the outlet, in order to reduce the pressure. In second embodiments, an outlet can be provided in addition to an inlet.

The actuating member can be moved and therefore adjusted relative to the chamber wall structure in an actuating direction and in an actuating counter direction which is opposite to the actuating direction. If the hydraulic device is a hydraulic pump, then adjusting the actuating member adjusts the delivery volume per stroke of the hydraulic pump. If the hydraulic pump is embodied as a rotary pump, then adjusting the actuating member adjusts the delivery volume per revolution of a delivery rotor of the pump. If the hydraulic pump is a linear stroke pump, then the delivery volume per linear stroke is adjusted. The delivery volume per stroke, i.e. per revolution or per linear stroke, is also referred to as the specific delivery volume. If the hydraulic device is a cam shaft phase setter, the actuating member is or can be coupled to a cam shaft of an internal combustion engine such that adjusting the actuating member relative to the chamber wall structure adjusts the phase position of the cam shaft relative to a crankshaft of the internal combustion engine.

The chamber wall structure and the actuating member lie opposite each other across a gap which delineates the pressure chamber. In order to effectively seal off this gap, a sealing element is provided in the gap on one of the chamber wall structure and the actuating structure, wherein said sealing element and the other of the chamber wall structure and the actuating structure form a sealing gap for sealing off the pressure chamber in a sealing contact. The sealing element comprises a sealing structure and a spring structure. The spring structure is supported or moulded on one of the chamber wall structure and the actuating structure and presses the sealing structure into the sealing contact with the other of the chamber wall structure and the actuating structure with a spring force.

In accordance with an aspect of the invention, the sealing structure and the spring structure are moulded in one piece, preferably from plastic. It is possible, by means of the spring structure, to ensure that the sealing structure is pressed into the sealing contact, and the pressure chamber is thus effectively sealed off, independently of the hydraulic fluid, for example independently of the pressure prevailing in the pressure chamber. In a hydraulic pump, this makes it possible to ensure that the pressure chamber is effectively sealed off even at a low rotational speed of the pump, such as for example when an internal combustion engine which drives the hydraulic pump is being started or in general when the hydraulic pump is being started. In a cam shaft phase setter, operational states can likewise occur in which no or too little hydraulic pressure is available to press the sealing structure into the sealing contact. Such situations typically occur when the internal combustion engine is being started or is idling. A monolithic sealing element can be more easily and more reliably fitted than multi-part sealing elements. If the sealing element comprising a sealing structure and a spring structure is moulded on one of the chamber wall structure and the actuating member, then there is no need from the outset for an additional fitting step; instead, it is merely necessary to fit the actuating member and, if the chamber wall structure is produced separately from the housing, the chamber wall structure.

Within the context of effectively sealing off a gap, it is also possible by means of the sealing element to implement a defined leakage across the sealing element. The sealing element can for example comprise one or more of the features which are disclosed in EP 2 365 193 B1 with respect to setting a defined leakage for the sealing element disclosed in said document.

The sealing structure and the spring structure can be moulded together in an original-moulding method. In alternative embodiments, the spring structure can be moulded onto the already moulded sealing structure, or the sealing structure can be moulded onto the already moulded spring structure, in an original-moulding method. Suitable original-moulding methods include sintering methods and in particular casting methods. Generative methods are likewise suitable original-moulding methods. The sealing element can thus for example be moulded in a 3D printing method.

Although the sealing element comprising a sealing structure and a spring structure can be moulded directly on one of the chamber wall structure and the actuating structure, embodiments in which the sealing element is manufactured separately from the chamber wall structure and the actuating member, as a monolithic sealing element, and mounted by a bearing on one of the chamber wall structure and the actuating member are preferred. The bearing takes the form of a support for the sealing element, for example a direct support for the spring structure. This support absorbs the spring force. The bearing also holds the sealing element in position, but allows the sealing structure to move in the direction of the sealing contact and in the opposite direction. The bearing preferably comprises a first guide, which guides the sealing structure in the direction of the sealing contact on a side which is a leading side in the actuating direction, and a second guide which guides the sealing structure in the direction of the sealing contact on a side which is a trailing side in the actuating direction.

In preferred embodiments, the actuating structure mounts the sealing element. In principle, however, it would also be possible to mount the sealing element on the chamber wall structure and form the sealing contact with the actuating member.

The sealing element can in particular be arranged in a cavity which comprises, opposite the sealing contact, one of the chamber wall structure and the actuating structure. In preferred embodiments, the cavity is provided on the actuating structure. In principle, however, a cavity could also be provided on the chamber wall structure instead, and the sealing element could be arranged in the cavity of the chamber wall structure. The cavity can comprise a base on which the sealing element is supported. The cavity can comprise mutually opposing side walls which guide the sealing structure, and optionally the spring structure, as it/they slide in the direction of the sealing contact and in the opposite direction.

In advantageous embodiments, the cavity has a linear profile. It is advantageously open on an end-facing side or on its mutually opposing end-facing sides. This makes it easier to axially insert the sealing element into the cavity when fitted in series production. The cavity expediently extends orthogonally with respect to an end-facing side of the actuating member or chamber wall structure. It can however also extend at an angle not equal to 90°; i.e. obliquely, with respect to the end-facing side. The cavity can in principle also describe a simple arc or can have an undulating profile, although this would mean that the sealing element could no longer be introduced from the end-facing side of the actuating structure or chamber wall structure and would have to be introduced via the circumference.

The spring structure can comprise a free rear side which faces oppositely away from the sealing structure and therefore the sealing contact and which simultaneously also forms a free rear side of the sealing element as a whole. The sealing element can be directly supported on the bearing, for example on the base of a cavity which accommodates the sealing element, via the free rear side of the spring structure. In such embodiments, it is directly supported via the spring structure only. In alternative embodiments, the sealing element can comprise an additional supporting structure which is connected to the spring structure, such that the sealing structure can be supported via the spring element and the additional supporting structure and is also supported when installed.

In first embodiments, the actuating member forms only one sliding gap comprising the sealing element in accordance with the invention. In a second embodiment, the actuating member and the same chamber wall structure or another chamber wall structure form a second sliding gap comprising another, second sealing element in accordance with the invention. In other embodiments, the actuating member and the chamber wall structure or one or more other chamber wall structures form yet another or multiple other sliding gaps, wherein a sealing element in accordance with the invention can be provided for sealing off each of said sliding gaps. The actuating member and the chamber wall structure or another chamber wall structure can for example form another sliding gap in order to delineate the same pressure chamber. In advantageous embodiments, a sealing element is also provided and configured in accordance with the invention in said other sliding gap.

An aspect of the invention also relates to a sealing element itself. The sealing element comprises a sealing structure comprising a front side, which comprises a sealing surface for a sliding contact which forms a seal, and a rear side which faces oppositely away from the front side. The sealing element also comprises a spring structure which is provided on the rear side of the sealing structure. In accordance with the invention, the sealing structure and the spring structure are moulded in one piece. Wherever features of the sealing element itself can be derived from the above embodiments regarding hydraulic devices, the sealing element can correspond to one or more of these features.

The sealing structure exhibits a maximum extension in a longitudinal direction of the sealing element. The front side and rear side of the sealing structure, and the rear side of the spring structure, extend in the longitudinal direction. The sealing element can in particular be linear in the longitudinal direction. In principle, however, the sealing element can also describe a simple arc or have an undulating profile in the longitudinal direction in a plan view onto its front side. This correspondingly applies to the sealing structure and the spring structure and an optionally provided additional supporting structure. In embodiments in which the upper side has a curved profile in the longitudinal direction, the spring structure and an optionally provided supporting structure follow(s) the contour of the sealing structure.

The spring structure can be spring-deflected in the direction of the rear side of the sealing structure by being elastically deformed. The upper side of the sealing structure can overlap the spring surface, in a plan view onto the upper side, over the entire profile of the spring surface. While the spring surface can be curved in the plan view, in order for example to follow a curved profile of the sealing structure, it is however curved in the plan view only if at all, i.e. can be produced by shifting a straight line in parallel, in preferred embodiments.

In advantageous embodiments, the spring surface of the spring structure which extends in the longitudinal direction and follows the profile of the sealing structure can be spring-deflected in the direction of the rear side of the sealing structure. The spring force which the spring structure exerts on the sealing structure when it is spring-deflected does not act on the sealing structure laterally but rather via the rear side of the sealing structure which faces oppositely away from the sealing surface. The spring force thus already acts at least substantially in a direction normal to the sealing contact on the rear side of the sealing structure. This is advantageous for the sealing contact itself. The sealing element can also be embodied so as to exhibit a small breadth transverse to the longitudinal direction.

With regard to its shape and spring constants, the spring structure is advantageously designed such that it is always subject to a spring biasing force under the conditions which are to be expected during operation, but does not come to rest on the block, i.e. a certain spring path always remains. The spring structure exhibits a spring constant which in advantageous embodiments is smaller than 10 N/mm or smaller than 6 N/mm. Conversely, it is advantageous if the spring constant of the spring structure is more than 1 N/mm or more than 2 N/mm or more than 3 N/mm. The sealing structure exhibits a spring constant which is many times larger than that of the spring structure. In advantageous embodiments, the sealing structure can be regarded as rigid, i.e. not deformable, in comparison with the spring structure.

Features of the invention are also described in the aspects formulated below. The aspects are worded in the manner of claims and can substitute for them. Features disclosed in the aspects can also supplement and/or qualify the claims, indicate alternatives to individual features and/or broaden claim features. Bracketed reference signs refer to example embodiments of the invention which are illustrated below in figures. They do not restrict the features described in the aspects to their literal sense as such, but do conversely indicate preferred ways of implementing the respective feature.

Aspect 1. A hydraulic device for an internal combustion engine or a gearing system, specifically a hydraulic pump exhibiting an adjustable delivery volume, or a hydraulic cam shaft phase setter for adjusting the phase position of a cam shaft relative to a crankshaft of an internal combustion engine, the hydraulic device comprising:

(a) a housing (1; 11) featuring a chamber wall structure (1*a*; 11*a*) which delineates a pressure chamber (K1) for a pressurised hydraulic fluid, wherein the pressure chamber (K1) can be formed in the housing (1, 1*b*; 11, 13, 14);

(b) an actuating member (5; 15) which can be adjusted in the housing (1; 11) relative to the chamber wall structure (1*a*; 11*a*) in an actuating direction (S) and in an actuating counter direction which is opposite to the actuating direction in order to adjust the delivery volume or phase position;

(c) and a sealing element (20; 50) comprising a sealing structure (21; 51) and a spring structure (24; 54) which is supported or moulded on one of the chamber wall structure (1*a*; 11*a*) and the actuating member (5; 15), preferably the actuating member, and presses the sealing structure (21; 51) into a sealing contact with the other of the chamber wall structure (1*a*; 11*a*) and the actuating member (5; 15) with a spring force in order to seal off the pressure chamber (K1);

(d) wherein the sealing structure (21; 51) and the spring structure (24; 54) are moulded in one piece.

Aspect 2. The hydraulic device according to the preceding aspect, wherein the sealing structure (21; 51) is a sealing strip which comprises a front side situated in the sealing contact and a rear side which faces oppositely away from the front side, and the spring structure (24; 54) protrudes from the rear side of the sealing structure (21; 51).

Aspect 3. The hydraulic device according to any one of the preceding aspects, wherein the sealing structure (21; 51) is a cylindrical sealing strip which extends in the longitudinal direction (L).

Aspect 4. The hydraulic device according to any one of the preceding aspects, wherein the sealing structure (21; 51) is a sealing strip which extends in the longitudinal direction (L) and comprises a solid cross-sectional profile or a closed hollow profile.

Aspect 5. The hydraulic device according to any one of the preceding aspects, wherein:

the sealing structure (21; 51) exhibits a maximum extension in a longitudinal direction (L) and comprises a front side, which extends in the longitudinal direction (L) and comprises a sealing surface (22; 52) for the sliding contact, and a rear side which extends in the longitudinal direction (L) and faces oppositely away from the front side; and the spring structure (24; 54) comprises a spring portion which extends in the longitudinal direction (L) on the rear side of the sealing structure (21; 51) and which alone or together with the sealing structure (21; 51) completely encompasses a free space into which the spring structure (24; 54) can be spring-deflected.

Aspect 6. The hydraulic device according to any one of the preceding aspects, wherein the sealing structure (21; 51) comprises a front side situated in the sealing contact, and the spring structure (24; 54) comprises a rear side which faces oppositely away from the front side of the sealing structure (21; 51), and the sealing structure (21; 51) and the spring structure (24; 54) extend from the front side of the sealing structure (21; 51) to the rear side of the spring structure (24; 54) in a spring plane in which the spring structure (24; 54) can be elastically deformed and which extends through the sealing contact and the rear side of the spring structure (24; 54).

Aspect 7. The hydraulic device according to any one of the preceding aspects, wherein in order to generate the spring force, the spring structure (24; 54) can be elastically deformed in a spring surface, preferably a spring plane, which extends transverse to the actuating direction (S), preferably orthogonally with respect to the actuating direction (S).

Aspect 8. The hydraulic device according to any one of the preceding aspects, wherein the spring structure (24; 54) forms a flexible spring and/or leaf spring in a spring plane which extends transverse to the actuating direction (S), preferably orthogonally with respect to the actuating direction (S).

Aspect 9. The hydraulic device according to any one of the preceding aspects, wherein the spring structure (24; 54) can be elastically deformed and is thus subject to a spring biasing force which presses the sealing structure (21; 51) into the sealing contact in all positions which the actuating member (5; 15) can assume relative to the chamber wall structure (1*a*; 11*a*) when the hydraulic device is in operation.

Aspect 10. The hydraulic device according to any one of the preceding aspects, wherein the sealing structure (21; 51) comprises a front side situated in the sealing contact and a rear side which faces oppositely away from the front side, and the rear side is in fluid communication (8; 18) with the pressure chamber (K1), such that the hydraulic fluid can be applied to the rear side of the sealing structure (21; 51) in the direction of the sealing contact.

Aspect 11. The hydraulic device according to any one of the preceding aspects, wherein the sealing element (20; 50) is arranged in a cavity (7; 17) of one of the chamber wall structure (1*a*; 11*a*) and the actuating member (5; 15).

Aspect 12. The hydraulic device according to the preceding aspect, wherein the cavity (7; 17) comprises side walls which face each other in the actuating direction (S) and enclose the sealing structure (21; 51) and guide it such that it can be moved in the direction of the sealing contact.

Aspect 13. The hydraulic device according to any one of the immediately preceding two aspects, wherein the cavity (7; 17) is connected to the pressure chamber (K1) via a fluid connection (8; 18), such that the pressure of the hydraulic fluid can be applied to the sealing structure (21; 51) in the cavity (7; 17) in the direction of the chamber wall structure (1*a*; 11*a*).

Aspect 14. The hydraulic device according to any one of the immediately preceding three aspects, wherein in the region of the spring structure (24; 54), for example in a root region of the spring structure (24; 54), the sealing element (20; 50) comprises a cavity (26; 56) and/or passage through which hydraulic fluid in the cavity (7; 17) can reach a rear side of the sealing structure (21; 51) which faces oppositely away from the sealing contact.

Aspect 15. The hydraulic device according to any one of the immediately preceding four aspects, wherein in the region of the spring structure (24; 54), for example in a root region of the spring structure (24; 54), the sealing element (20; 50) is narrower than the cavity (7; 17) in the actuating direction (S), throughout or only in regions.

Aspect 16. The hydraulic device according to any one of the immediately preceding five aspects, wherein the front side of the sealing structure (21; 51) comprises a sealing surface (22; 52) which is in the sealing contact with the chamber wall structure (1*a*; 11*a*), and a rear side of the spring structure (24; 54) which faces oppositely away from the sealing surface (22; 52) locally comprises a supporting region (25; 55) via which the sealing element (20; 50) is supported in the cavity (7; 17) by a pressure contact.

Aspect 17. The hydraulic device according to the preceding aspect, wherein the sealing surface (22; 52) is larger than, and preferably at least twice as large as, the surface of the supporting region (25; 55) situated in the pressure contact.

Aspect 18. The hydraulic device according to any one of the preceding aspects, wherein the sealing structure (21; 31; . . . ; 111) exhibits a base leakage cross-section which extends across the sealing gap in the actuating direction (S) for a defined leakage.

Aspect 19. The hydraulic device according to any one of the preceding aspects, wherein: the hydraulic device comprises a rotor (3; 15) which can be rotated about a rotational axis (R); the actuating member (5; 15) surrounds the rotor (3) or forms the rotor (15) and comprises a circumference which extends around the rotational axis (R) and lies opposite the chamber wall structure (1*a*; 11*a*) in the region of the sealing gap; and the sealing gap and the sealing element (20; 50) extend in a direction which comprises an axial directional component which is parallel to the rotational axis (R).

Aspect 20. The hydraulic device according to the preceding aspect, wherein the sealing gap and the sealing element (20; 50) extend parallel to the rotational axis (R).

Aspect 21. The hydraulic device according to any one of the immediately preceding two aspects, wherein the circumference of the actuating member (5; 15) which lies opposite the chamber wall structure (1*a*; 11*a*) in the region of the sealing gap is an outer circumference of the actuating member (5; 15).

Aspect 22. The hydraulic device according to any one of the preceding aspects, wherein the hydraulic device is an external-axle or internal-axle hydraulic pump which can be adjusted in terms of its delivery volume and which comprises a delivery rotor (3) which can be rotary-driven about a rotational axis (R), for example a vane cell pump or toothed wheel pump or toothed ring pump or pendulum-slider pump, and when the hydraulic pump is embodied as an internal-axle pump, the actuating member (5) surrounds the delivery rotor (3) and can be moved back and forth in a direction transverse to the rotational axis (R) relative to the delivery rotor (3) in order to adjust the delivery volume, and when the hydraulic pump is embodied as an external-axle pump, the actuating member (5) mounts the delivery rotor (3) such that it can be rotated about the rotational axis (R) and can be moved back and forth in the direction of the rotational axis (R) together with the delivery rotor (3) in order to adjust the delivery volume.

Aspect 23. The hydraulic device according to any one of the preceding aspects, wherein the hydraulic device is a hydraulic cam shaft phase setter, the housing (11) is a stator of the cam shaft phase setter, and the actuating member (15) is a rotor of the cam shaft phase setter, wherein the stator is or can be connected, in a way which transmits torque, to a crankshaft of an internal combustion engine, and the rotor is or can be connected, in a way which transmits torque, to a cam shaft of the internal combustion engine.

Aspect 24. A sealing element, preferably the sealing element of the hydraulic device according to any one of the preceding aspects, comprising:

(1) a sealing structure (21; 31; . . . ; 121) which exhibits a maximum extension in a longitudinal direction (L) and comprises: a front side which extends in the longitudinal direction (L) and comprises a sealing surface (22; 32; . . . ; 122) for a sliding contact which forms a seal; and a rear side which extends in the longitudinal direction (L) and faces oppositely away from the front side;

(2) and a spring structure (24; 34; . . . ; 124) on the rear side of the sealing structure (21; 31; . . . ; 121);

(3) wherein the spring structure (24; 34; . . . ; 124) can be spring-deflected in the direction of the rear side of the sealing structure (21; 31; . . . ; 121), (4) and wherein the sealing structure (21; 31; . . . ; 121) and the spring structure (24; 34; . . . ; 124) are moulded in one piece.

Aspect 25. The sealing element according to the preceding aspect, wherein the sealing structure (21; 31; . . . ; 121) and the spring structure (24; 34; . . . ; 124) are moulded together in an original-moulding method, or wherein one is moulded onto the other in an original-moulding method.

Aspect 26. The sealing element according to any one of the preceding aspects, wherein the sealing structure (21; 31; . . . ; 121) and/or the spring structure (24; 34; . . . ; 124) is/are moulded generatively or in a casting method from plastic.

Aspect 27. The sealing element according to any one of the preceding aspects, wherein the sealing structure (21; 31; . . . ; 121) and/or the spring structure (24; 34; . . . ; 124) is/are moulded in a casting method, for example an injection-moulding method, from plastic.

Aspect 28. The sealing element according to any one of Aspects 24 to 26, wherein the sealing structure (21; 31; . . . ; 121) and/or the spring structure (24; 34; . . . ; 124) is/are moulded generatively, for example in a 3D printing method, from plastic.

Aspect 29. The sealing element according to any one of the preceding aspects, wherein the sealing structure (21; 31; . . . ; 121) and/or the spring structure (24; 34; . . . ; 124) consist(s) completely, or only in regions, of plastic, preferably a thermoplastic and/or thermosetting material, wherein the plastic optionally contains one or more different additives, preferably reinforcing fibres and/or reinforcing particles and/or a sliding additive for improving the sliding characteristic.

Aspect 30. The sealing element according to the preceding aspect, wherein the plastic is a polymer compound consisting of at least one heat-resistant polymer filled with a reinforcing material and/or sliding additive.

Aspect 31. The sealing element according to any one of the immediately preceding two aspects, wherein the plastic contains graphite and/or fluoropolymer, preferably PTFE, as the sliding additive.

Aspect 32. The sealing element according to any one of the immediately preceding three aspects, wherein the plastic contains carbon fibres and/or glass fibres.

Aspect 33. The sealing element according to any one of the immediately preceding four aspects, wherein a base material of the plastic is a polymer including co-polymer, a mixture of polymers or a polymer blend from the group consisting of polyethersulphone (PES), polysulphone (PSU), polyphenylene sulphide (PPS), polyetherketones (PAEK, PEK, PEEK), polyamide (PA) and polyphthalamide (PPA).

Aspect 34. The sealing element according to any one of the preceding aspects, wherein the sealing structure (21; 31; . . . ; 121) consists completely, or only in regions, of a first plastic, and the spring structure (24; 34; . . . ; 124) consists completely, or only in regions, of the same plastic.

Aspect 35. The sealing element according to any one of the preceding aspects, wherein the sealing structure (21; 31; . . . ; 121) consists completely, or only in regions, of a first plastic, and the spring structure (24; 34; . . . ; 124) consists completely, or only in regions, of another, second plastic.

Aspect 36. The sealing element according to any one of the immediately preceding two aspects, wherein the sealing structure (21; 31; . . . ; 121) comprises a rigidifying structure which is embedded in the first plastic, provides rigidity against bending and is preferably resistant to bending, and extends over preferably half the length of the sealing structure.

Aspect 37. The sealing element according to any one of the immediately preceding three aspects, wherein the spring structure (24; 34; . . . ; 124) comprises a spring element and/or rigidifying element which is embedded in the plastic, is elastically flexible, and extends over preferably at least half the length of the spring structure.

Aspect 38. The sealing element according to the preceding aspect, wherein the spring element and/or rigidifying element is a spring metal sheet.

Aspect 39. The sealing element according to any one of the preceding aspects, wherein a thermoplastic material forms the sealing surface (22; 32; . . . ; 122) of the sealing structure (21; 31; . . . ; 121) and preferably the entire sealing structure.

Aspect 40. The sealing element according to any one of the preceding aspects, wherein the spring structure (24; 34; . . . ; 124) consists completely, or only in regions, of an elastomer material.

Aspect 41. The sealing element according to any one of the preceding aspects, wherein the sealing structure (21; 31; . . . ; 121) and/or the spring structure (24; 34; . . . ; 124) consists completely, or only in regions, of thermosetting material.

Aspect 42. The sealing element according to any one of the preceding aspects, wherein the spring structure (24; 34; . . . ; 124) is dimensionally elastic.

Aspect 43. The sealing element according to the preceding aspect, wherein the spring structure (24; 34; . . . ; 124) is a flexible spring and/or a leaf spring.

Aspect 44. The sealing element according to any one of the preceding aspects, wherein the sealing structure (21; 31; . . . ; 121) is a sealing strip, preferably a beam-shaped or rod-shaped sealing strip and/or a sealing strip which is resistant to bending in a spring plane of the spring structure (24; 34; . . . ; 124).

Aspect 45. The sealing element according to any one of the preceding aspects, wherein the sealing structure (21; 51) is a solid profile which extends in the longitudinal direction (L) or a hollow profile which is circumferentially closed in cross-section.

Aspect 46. The sealing element according to any one of the preceding aspects, wherein the sealing structure (21; 51) is a cylindrical sealing strip which extends in the longitudinal direction (L) and is preferably shaped as a slim cuboid which is elongated in the longitudinal direction.

Aspect 47. The sealing element according to any one of the preceding aspects, wherein the spring structure (24; 34; . . . ; 124) can be spring-deflected, preferably bent elastically, in the direction of the rear side of the sealing structure (21; 31; . . . ; 121) in a spring surface which extends in the longitudinal direction (L) and follows the profile of the sealing structure (21; 31; . . . ; 121).

Aspect 48. The sealing element according to the preceding aspect, wherein the spring surface can be produced, preferably as a spring plane, by offsetting a straight line along the sealing structure (21; 31; . . . ; 121) in parallel.

Aspect 49. The sealing element according to any one of the preceding aspects, wherein the sealing structure (21; 31; . . . ; 121) extends in a spring plane of the spring structure (24; 34; . . . ; 124).

Aspect 50. The sealing element according to any one of the preceding aspects, wherein the sealing structure (21; 31; . . . ; 121) is a sealing strip, and the spring structure (24; 34; . . . ; 124) can be elastically bent along the sealing structure (21; 31; . . . ; 121).

Aspect 51. The sealing element according to the preceding aspect, wherein the sealing structure (21; 31; . . . ; 121) is more resistant to bending than the spring structure (24; 34; . . . ; 124).

Aspect 52. The sealing element according to any one of the preceding aspects, wherein the spring structure (24; 54) has a spring constant of at least 2 N/mm.

Aspect 53. The sealing element according to any one of the preceding aspects, wherein the spring structure (24; 54) has a spring constant of at most 6 N/mm.

Aspect 54. The sealing element according to any one of the preceding aspects, wherein the sealing structure (21; 31; . . . ; 121) exhibits a spring constant which is more than twice or more than five times or more than ten times as large as a spring constant of the spring structure (24; 54).

Aspect 55. The sealing element according to any one of the preceding aspects, wherein the sealing structure (21; 31; . . . ; 121) is a sealing strip and comprises parallel side walls which extend in the longitudinal direction (L).

Aspect 56. The sealing element according to any one of the preceding aspects, wherein the sealing structure (21; 31; . . . ; 121) is a sealing strip which extends in the longitudinal direction (L), and the spring structure (24; 34; . . . ; 124) can be elastically deformed in a spring plane which extends in the longitudinal direction (L), in order to generate the spring force.

Aspect 57. The sealing element according to the preceding aspect, wherein the spring structure (24; 34; . . . ; 124) comprises a flexible spring and/or leaf spring which extends in the spring plane and which can be elastically deformed.

Aspect 58. The sealing element according to any one of the preceding aspects, wherein the sealing structure (21; 31; . . . ; 121) is a sealing strip, and the spring structure (24; 34; . . . ; 124) is spring-deflected, in a spring plane which extends in the longitudinal direction (L) of the sealing structure (21; 31; . . . ; 121), by a force which acts linearly on the sealing element (20; 30; . . . ; 120) in the spring plane, while the sealing structure (21; 31; . . . ; 121) is at least practically not deformed by the same force.

Aspect 59. The sealing element according to any one of the preceding aspects, wherein the sealing structure (21; 31; . . . ; 121) exhibits a length in the longitudinal direction (L), a thickness orthogonally with respect to the length, and a breadth orthogonally with respect to the length and the thickness, and the length is more than twice as large as a maximum thickness and a maximum breadth.

Aspect 60. The sealing element according to any one of the preceding aspects, wherein the sealing structure (21; 31; . . . ; 121) completely overlaps the spring structure (24; 34; . . . ; 124) in a plan view onto the sealing surface (22; 32; . . . ; 122).

Aspect 61. The sealing element according to any one of the preceding aspects, wherein the spring structure (24; 34; . . . ; 114) can be elastically deformed in a spring surface, preferably a spring plane, which can be produced by shifting a straight line in the longitudinal direction (L) of the sealing structure (21; 31; . . . ; 111) in parallel, and wherein the spring structure (24; 34; . . . ; 114) comprises a spring portion which extends at a clear distance from the rear side of the sealing structure (21; 31; . . . ; 111) and overlaps with the sealing structure (21; 31; . . . ; 111) in the spring surface.

Aspect 62. The sealing element according to any one of the preceding aspects, wherein the spring structure (24; 34; . . . ; 114) comprises a spring portion which extends at a clear distance from the rear side of the sealing structure (21; 31; . . . ; 111) and overlaps with the sealing structure (21; 31; . . . ; 111) in the longitudinal direction (L) from a first end to a second end and protrudes from the sealing structure (21; 31; . . . ; 111) at the first and/or second end.

Aspect 63. The sealing element according to the preceding aspect, wherein the spring portion is connected to the sealing structure (21; 31; 41; 51; 91) at the first end and second end or forms a self-contained arc (104; 114), such that the spring structure (24; 34; 44; 54; 94; 104; 114) alone or together with the sealing structure (21; 31; 41; 51; 91; 101; 111) encompasses a free space into which the spring structure (24; 54) can be spring-deflected.

Aspect 64. The sealing element according to Aspect 61 or Aspect 62, wherein the spring portion protrudes from the sealing structure (61; 71; 81) at the first end, and the second end is a free end which exhibits a clear distance from the sealing structure (61; 71; 81).

Aspect 65. The sealing element according to any one of the immediately preceding four aspects, wherein the spring portion describes an arc which is uniformly concave with respect to the sealing structure (21; 31; . . . ; 111) in the longitudinal direction (L) or undulates in the longitudinal direction (L) or transverse to the longitudinal direction (L).

Aspect 66. The sealing element according to any one of the preceding aspects, wherein in the region of the spring structure, for example in a root region of the spring structure, the sealing element (20; 30; 40; 50; 110) comprises a cavity (26; 36; 46; 56; 116) and/or passage for hydraulic fluid.

Aspect 67. The sealing element according to any one of the preceding aspects, wherein in the region of the spring structure, for example in a root region of the spring structure, the sealing element (20; 30; 40; 50; 110) is narrower than the spring structure in the actuating direction (S), throughout or only in regions.

Aspect 68. The sealing element according to any one of the preceding aspects, wherein: the spring structure (64; 74; 114) comprises a first spring portion and a second spring portion, each comprising a free end; the spring portions project from the sealing structure (61; 71; 111) and extend at a clear distance from the rear side in a longitudinal direction (L) of the sealing structure (61; 71; 111); and the free ends of the spring portions point towards each other or away from each other in the longitudinal direction (L).

Aspect 69. The sealing element according to any one of the preceding aspects, wherein the sealing structure (21; 31; . . . ; 111) is a sealing strip comprising a longitudinal axis (L), and the sealing element (20; 30; . . . ; 110) is symmetrical with respect to a longitudinal plane which contains the longitudinal axis and intersects the sealing surface (22; 32; . . . ; 112).

Aspect 70. The sealing element according to any one of the preceding aspects, wherein the sealing structure (21; 31; 41; 51; 61; 71; 81; 101; 111; 121) is a sealing strip comprising a longitudinal axis (L), and the spring structure (24; 34; 44; 54; 64; 74; 84; 104; 114; 124) and the sealing structure are symmetrical with respect to a cross-sectional plane which is orthogonal with respect to the longitudinal axis (L).

Aspect 71. The sealing element according to any one of the preceding aspects, comprising another sealing structure (111; 121) comprising another front side, which comprises another sealing surface (112; 122) for a sliding contact which forms a seal, and a rear side which faces oppositely away from said other front side, wherein the spring structure (64; 124) is arranged between the sealing structures (111; 121) and moulded in one piece with the sealing structures (111; 121).

Aspect 72. The sealing element according to any one of the preceding aspects, wherein the sealing structure (21; 31; . . . ; 121) comprises one or more cavities on the front side for setting a defined leakage, wherein the cavity or cavities breach(es) or adjoin(s) the sealing surface (22; 32; . . . ; 122), wherein the sealing surface (22; 32; . . . ; 122) protrudes beyond the one or more cavities in the direction of the sealing contact.

Aspect 73. The sealing element according to any one of the preceding aspects, which is provided or used for sealing off a sealing gap between a chamber wall structure 1*a*; 11*a*) and an actuating member (5; 15)—which can be moved relative to the chamber wall structure (1*a*; 11*a*)—of a hydraulic device, preferably the hydraulic device according to any one of Aspects 1 to 23.

BRIEF DESCRIPTION OF THE DRAWINGS

The invention is described below on the basis of example embodiments. Features disclosed by the example embodiments, each individually and in any combination of features which are not mutually exclusive, advantageously develop the subject-matter of the claims and aspects and also the embodiments described prior to the aspects. There is shown:

DETAILED DESCRIPTION OF THE INVENTION

Figure 1:
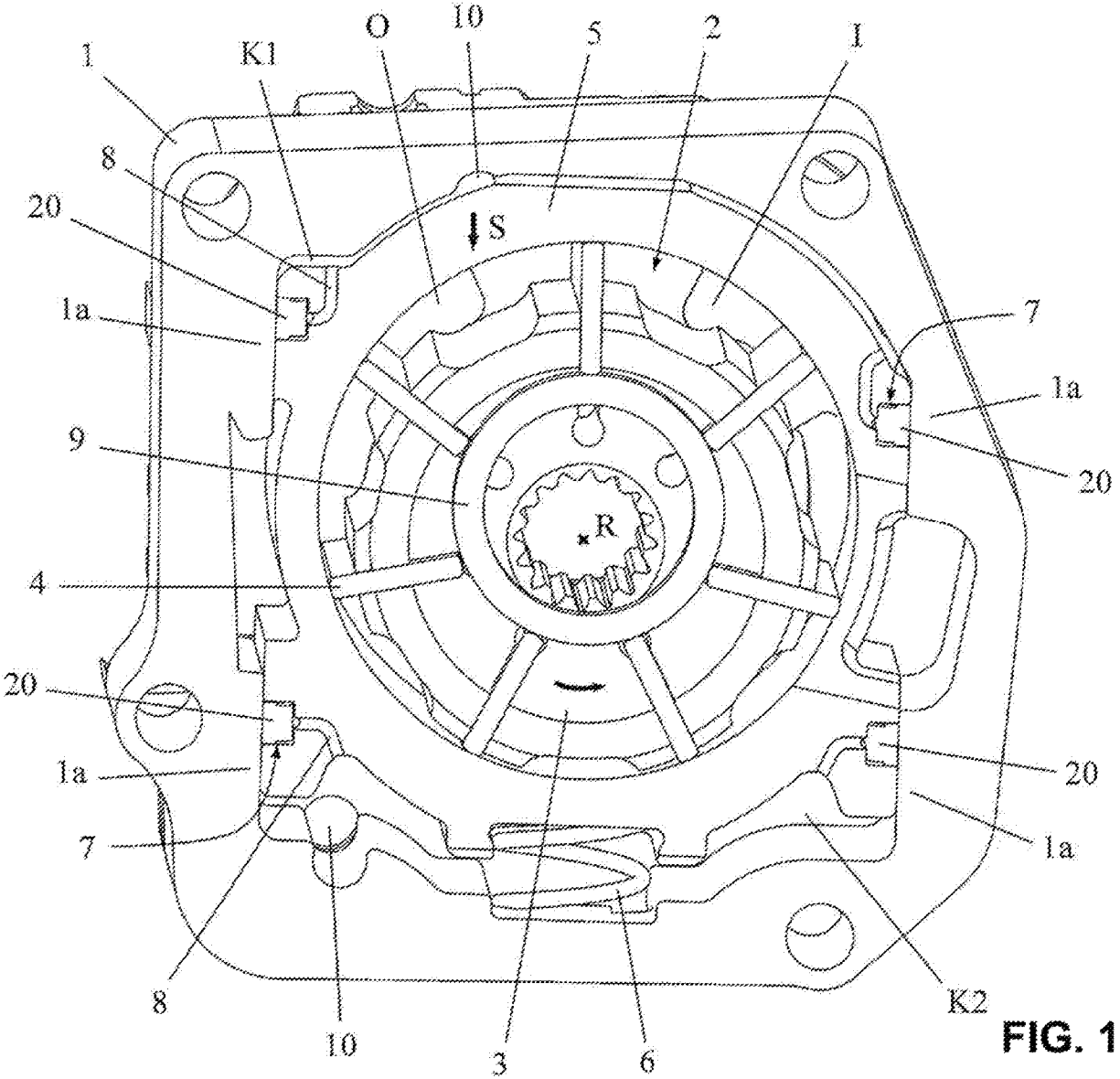
FIG. 1 a hydraulic pump comprising sealing elements, in a view onto an end-facing side.

FIG. 1 shows a hydraulic rotary pump, which is embodied by way of example as a vane cell pump, in a perspective view onto an end-facing side of the pump. The pump comprises a housing 1. A housing cover has been removed, such that the functional components of the pump which are accommodated by the housing 1 can be seen. A delivery chamber 2 is formed in the housing 1, wherein a delivery rotor 3 is arranged in the delivery chamber 2 such that it can be rotated about a rotational axis R. The delivery chamber 2 comprises a low-pressure side and a high-pressure side. When the delivery rotor 3 is rotary-driven in the rotational direction indicated, i.e. anti-clockwise, a hydraulic fluid—for example, a lubricating oil or working oil—flows into the delivery chamber 2 via an inlet channel on the low-pressure side of the pump and through an inlet I and is expelled from the delivery chamber 2 at an increased pressure on the high-pressure side through an outlet O and discharged via an adjoining outlet channel, for example as a lubricating oil to lubricating points of an internal combustion engine and/or gearing system or as a working oil to a subsequent hydraulic device.

The delivery rotor 3 is a vane wheel comprising vanes 4 which are arranged in a distribution around the rotational axis R. The outer circumference of the delivery rotor 3 is surrounded by an actuating member 5. When the delivery rotor 3 is rotary-driven, the vanes 4 slide over an inner circumferential surface of the actuating member 5. The vanes 4 are supported radially inwards on a supporting ring 9 which is arranged such that it can be moved. The actuating member 5 is annular, but can in principle also deviate more significantly than in the example embodiment from a uniformly annular shape. The rotational axis R is arranged eccentrically with respect to a parallel central axis of the actuating member 5, such that the delivery rotor 3 and the actuating member 5 form delivery cells which increase in size in the rotational direction on the low-pressure side of the delivery chamber 2 and decrease again in size on the high-pressure side. Due to this increase and decrease in the size of the delivery cells which is periodic with the rotational speed of the delivery rotor 3, the hydraulic fluid is suctioned through the inlet I on the low-pressure side and expelled at an increased pressure through the outlet O on the high-pressure side and discharged.

The volume of fluid which is delivered per revolution of the delivery rotor 3, the so-called specific delivery volume, can be adjusted. The specific delivery volume depends on the eccentricity, i.e. the distance between the central axis of the actuating member 5 and the rotational axis R of the delivery rotor 3. In order to be able to change this axial distance, the actuating member 5 is arranged such that it can be adjusted back and forth in the housing 1 relative to the delivery rotor 3 in an actuating direction S and in an actuating counter direction which is opposite to the actuating direction S. In the example embodiment, the actuating member 5 can be adjusted linearly. In other embodiments, it can be able to be pivoted, as is for example known from DE 10 2011 086 175 B3. In yet other alternative embodiments, the respective actuating member can in principle be mounted such that its actuating movement is a superimposed movement consisting of a translation and a rotation. The ability of the actuating member 5 to be moved and/or adjusted is at any rate such that the actuating movement can adjust the eccentricity between the delivery rotor 3 and the actuating member 5 and therefore the delivery volume. This applies not only to vane cell pumps but also to other internal-axle pumps such as for example toothed ring pumps and pendulum-slider pumps.

For adjusting in the actuating direction S, a pressure of the delivered hydraulic fluid which acts in the actuating direction S is applied to the actuating member 5. The restoring force of a spring 6 acts counter to this pressure. The restoring force acts in the actuating counter direction. In the example embodiment, the restoring force is generated by a single spring 6. In alternative embodiments, the restoring force can also be generated by the combined action of two or more springs and, in other alternatives, by a gas pressure device. The restoring force is expediently a spring force. Irrespective of whether it is generated mechanically and/or by gas pressure, the spring force expediently acts in the direction of increasing the delivery volume.

In order to generate the hydraulic actuating force which acts in the actuating direction S, a pressure chamber K1 is formed on a rear side of the actuating member 5 which faces oppositely away from the spring 6. The pressure chamber K1 is delineated on the radially outer side in relation to the rotational axis R by the housing 1 and on the radially inner side by the actuating member 5. The pressure chamber K1 comprises an inlet 10 through which hydraulic fluid delivered by the pump can flow into the pressure chamber K1 and also flow off out of the pressure chamber K1 again in order to relieve the pressure on the actuating member 5. The inlet 10 can be connected directly to the high-pressure side of the delivery chamber 2. It is alternatively also possible to not connect the inlet/outlet 10 to the high-pressure side of the pump until a point downstream of the delivery chamber 2 and/or outlet O, expediently via a connecting channel which also extends within the housing 1.

The outer circumference of the actuating member 5 and oppositely facing chamber wall structures 1*a* form narrow sliding gaps which extend in the actuating direction S, namely a left-hand sliding gap and a right-hand sliding gap, in order to seal off the pressure chamber K1. The actuating member 5 and an end-facing wall of the housing 1, and the actuating member 5 and an end-facing wall of the removed housing cover, also form axial sliding gaps for sealing off the pressure chamber K1. The chamber wall structures 1*a* are constituent parts of the housing 1. In modifications, the chamber wall structures can however also be formed by wall structures which are produced separately from the housing 1 and arranged in the housing 1, as long as it can be ensured that the pressure chamber K1 has a sufficient strength of seal.

In order to improve the seal, sealing elements 20 are arranged in the region of the sliding gaps formed by the actuating member 5 and the chamber wall structures 1*a*, for example one sealing element 20 for each respective gap. The outer circumference of the actuating member 5 comprises cavities 7. One of the sealing elements 20 is respectively arranged in each one of the cavities 7. The respective sealing element 20 is supported on a base of the accommodating cavity 7 and is guided by the side walls of the cavity 7 such that it can slide in the direction of a sealing contact with the opposing chamber wall structure 1*a* and in the opposite direction. The breadth of the respective cavity 7, as measured in the actuating direction S, and the breadth of the sealing element 20 accommodated in said cavity, as measured in the actuating direction S, are mutually adjusted such that the sealing element 20 cannot perform any practically significant movements within its cavity 7 relative to the actuating member 5 in and counter to the actuating direction S. Because it is enclosed by the side walls, the sealing element 20 also in particular cannot tilt and/or twist. The side walls and/or the guide on both sides provided by the side walls ensures that the accommodated sealing element 20 always has a perfect sealing contact with the opposing chamber wall structure 1*a* and that the sealing contact remains intact even during rapid and direction-changing movements of the actuating member 5.

The cavities 7 which accommodate the sealing elements 20 for sealing off the pressure chamber K1 are each in fluid communication with the pressure chamber K1 via a connecting channel 8. The hydraulic fluid from the pressure chamber K1 is applied via the respective connecting channel 8 to a rear side of the respective sealing element 20 which faces away from the opposing chamber wall structure 1*a*, and the sealing element 20 is thus pressed hydraulically into the sliding contact.

Another pressure chamber K2 is formed opposite the pressure chamber K1 across the rotational axis R, between an outer circumference of the actuating member 5 and an opposing inner circumference of the housing 1. The spring 6 is arranged in the pressure chamber K2. The hydraulic fluid delivered by the pump can also be introduced into the pressure chamber K2. For this purpose, the pressure chamber K2 comprises an inlet 10 of its own which simultaneously also forms the outlet of the pressure chamber K2. By introducing the pressure fluid into the pressure chamber K2, it is possible to hydraulically block the actuating member 5 in a desired actuating position and relieve the spring 6. Said other pressure chamber K2 can in principle be omitted, such that the spring 6 only acts counter to the pressure prevailing in the pressure chamber K1. In embodiments, such as the example embodiment, in which a first pressure chamber—for example, the pressure chamber K1—is provided on the circumference of the actuating member 5, and a second pressure chamber—for example, the pressure chamber K2—is provided so as to act counter to the first pressure chamber, then it is also possible to completely omit a spring, since the actuating member can be moved purely hydraulically into any actuating position and hydraulically blocked in said actuating position by appropriately applying pressure to the two pressure chambers K1, K2.

The pressure chamber K2 is sealed off in the same way as the pressure chamber K1. In order to seal off the pressure chamber, the outer circumference of the actuating member 5 and opposing chamber wall structures 1 a form other sliding gaps—in the example embodiment, a left-hand and right-hand sliding gap. In order to improve the seal, other sealing elements 20 are arranged in the sliding gaps—in the example embodiment, one sealing element 20 for each respective sliding gap. The statements made with respect to the sliding gaps, the sealing elements 20, the sealing gaps thus formed and the cavities 7 within the context of the pressure chamber K1 similarly apply to the sliding gaps, the sealing elements 20, the sealing gaps thus formed and the cavities 7 for the pressure chamber K2, wherein the cavities 7 assigned to the pressure chamber K2 are in fluid communication with the pressure chamber K2 via connecting channels 8 for applying a hydraulic force to the sealing elements 20.

Figure 2:
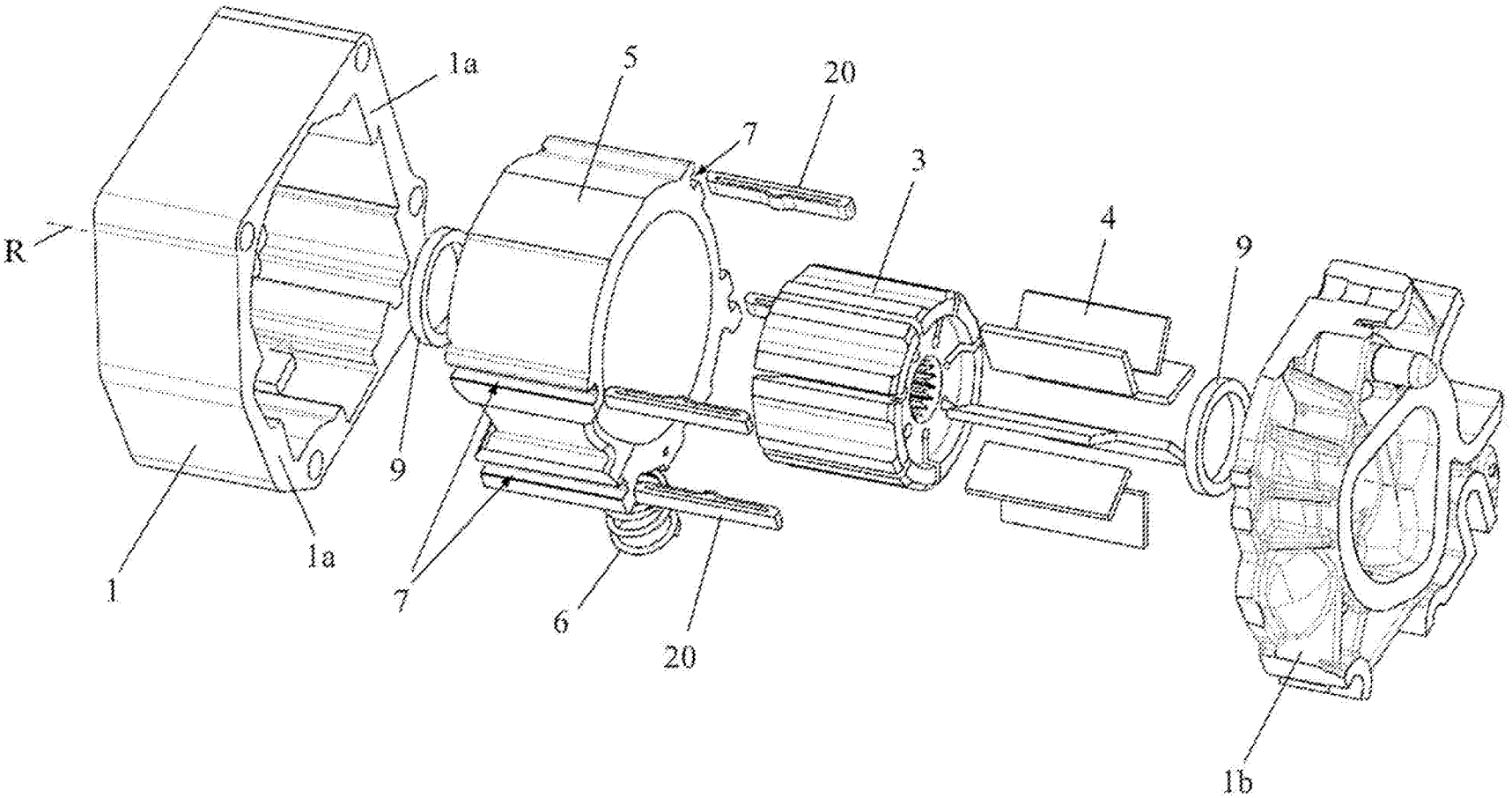
FIG. 2 an exploded representation of components of the hydraulic pump.

FIG. 2 shows the functional components of the hydraulic pump which have already been described, in an exploded representation, i.e. in positions removed from each other. The components can be pushed into or onto each other from the positions shown by being shifted parallel to the rotational axis R, thus enabling the pump to be assembled. FIG. 2 also shows the housing cover 1*b* which closes off the housing 1 and therefore the delivery chamber 2 and the pressure chambers K1 and K2 on one of the two end-facing sides. The housing 1 and the housing cover 1*b* can also be jointly referred to as the "housing".

The sealing elements 20 can be axially inserted into the cavities 7 or can also in principle instead be introduced radially into the cavities 7. When fitted in series production, the actuating member 5 is inserted into the housing 1 which is open on its end-facing side which faces the housing cover 1*b*. Advantageously, the sealing elements 20 are only then axially inserted into the cavities 7. If the sealing elements 20 are axially inserted into the cavities 7 of the actuating member 5 or introduced radially from without into the radially open cavities 7 before the actuating member 5 is inserted, which is in principle possible, then the sealing elements have to be held in the cavities 7 as the actuating member 5 is fitted.

Figure 3:
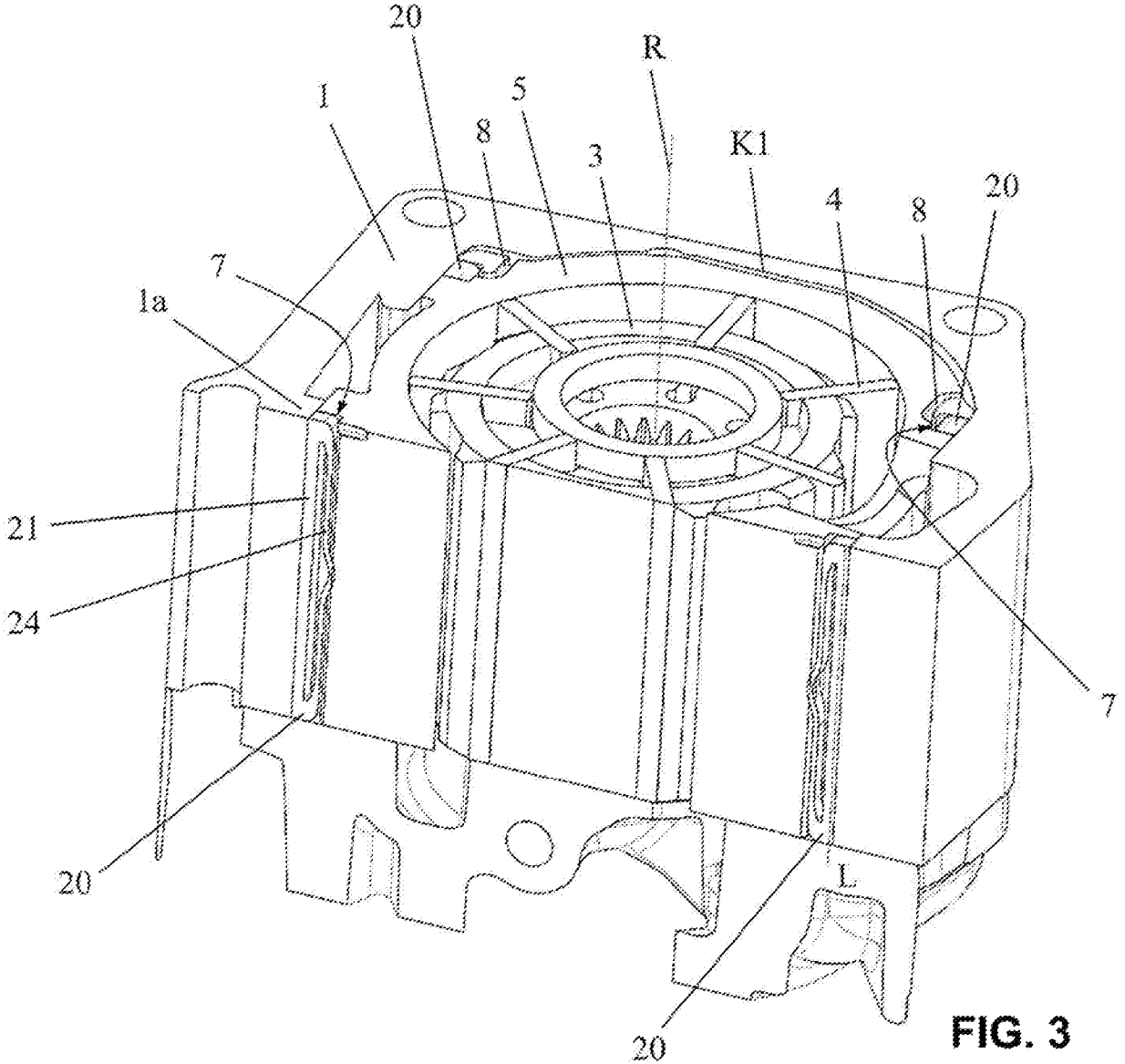
FIG. 3 a view onto a sectional plane of the hydraulic pump.

FIG. 3 shows the hydraulic pump, with the housing cover 1*b* (FIG. 2) removed, in a perspective view onto a longitudinal sectional plane which extends through two sealing elements 20. The sealing elements 20 respectively comprise structural regions having different functions. The structural regions are a sealing structural region 21, which is referred to in the following as the sealing structure, and a spring structural region 24 which is referred to in the following as the spring structure. The sealing structure 21 of the respective sealing element 20 is in sealing contact with the opposing chamber wall structure 1*a*. The spring structure 24 is supported on the actuating member 5 opposite the chamber wall structure 1*a*—in the example embodiment, on the base of the accommodating cavity 7—and presses the sealing structure 21 into the sealing contact with a spring force.

The sealing elements 20 are elongated in a longitudinal direction L. The respective sealing structure 21 is a sealing strip which extends in the longitudinal direction L. The cavities 7 are axially linear. In the example embodiment, they extend parallel to the rotational axis R. In modifications, they could also extend obliquely with respect to the rotational axis R, i.e. they could cross the rotational axis R at a distance. In other modifications, the cavities could describe a simple arc or have an undulating profile on the outer circumference of the actuating member 5 in a plan view onto the outer circumference. The sealing structures 21 are linear in the longitudinal direction L in accordance with the profile of the cavities 7. In the modifications mentioned, they could also describe a simple arc or exhibit an undulating profile in a plan view onto the outer circumference of the actuating member 5. However, linear cavities 7 and sealing elements 20 which are correspondingly linear in the longitudinal direction L make it easier to fit them, since the sealing elements 20 can be inserted into the cavities 7 in the longitudinal direction L, for example parallel to the rotational axis R, from the end-facing side.

The spring force generated by spring-deflecting the spring structure 24 is introduced into the sealing structure 21 in the direction of the sealing contact on the rear side of the sealing structure 21 of the respective sealing element 20 which faces oppositely away from the sealing contact. The spring force is generated by elastically deforming the respective spring structure 24 in a spring plane which extends in the longitudinal direction L of the respective sealing element 20. If the sealing elements 20 were arc-shaped or undulating in a plan view onto the outer circumference of the actuating member 5, the respective spring structure 24 would be elastically deformed in a correspondingly arc-shaped or undulating spring surface.

The sealing elements 20 are each arranged so as to exhibit a spring biasing force. The spring biasing force is set such that the respective sealing structure 21 is pressed into the sealing contact with a certain spring force, i.e. a spring force other than zero, in all actuating positions which the actuating member 5 can assume. This can compensate for a variation in the width of the respective sliding gap. In advantageous embodiments, the spring biasing force is large enough that the spring structure 24 presses the sealing structure 21 of the same sealing element 20 into the sealing contact with the opposing chamber wall structure 1 a in all operational states of the pump. This compensates for differences in the thermal expansions of the components forming the respective sliding gap, specifically the actuating member 5 and the chamber wall structures 1*a*. In yet another improvement, the spring biasing force is large enough that variations in the gap width, which can occur during the actuating movement and/or due to changes in temperature, are compensated for by the spring biasing force over the planned service life of the pump. It is also advantageous if a spring bias which is established even as the sealing element 20 is fitted, and a spring biasing force which is thus generated, also compensate for a relaxation of the material of the respective sealing element 20 which sets in over its operating time.

The cavities 7 extend axially and continuously parallel to the rotational axis R, i.e. they are open at their two end-facing sides. In advantageous embodiments, the sealing structures 21 extend over the entire axial length of the respective cavity 7, such that they also form sealing gaps with the end-facing surfaces of the housing 1 and housing cover 1*b* which face axially opposite.

Figure 4:
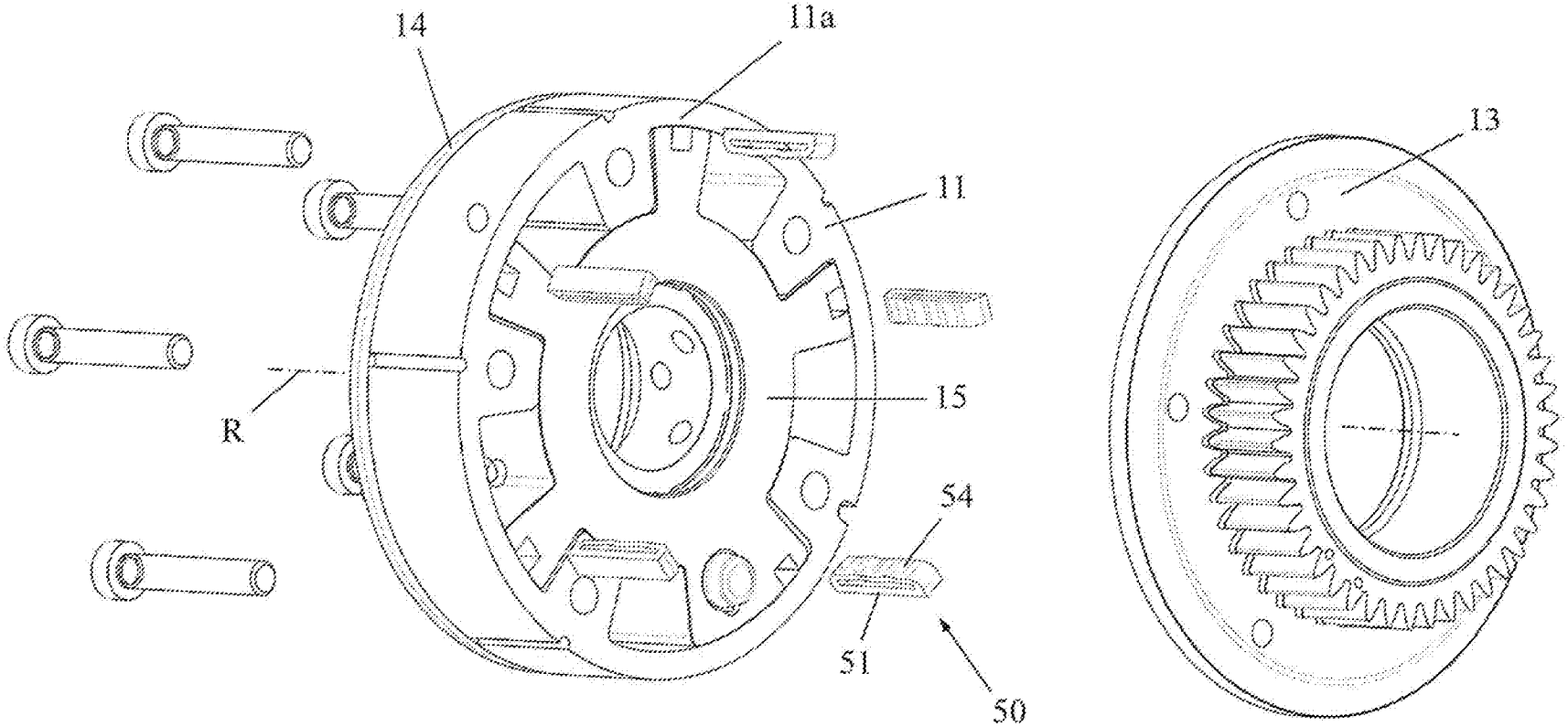
FIG. 4 an exploded representation of components of a cam shaft phase setter provided with sealing elements.
Figure 6:
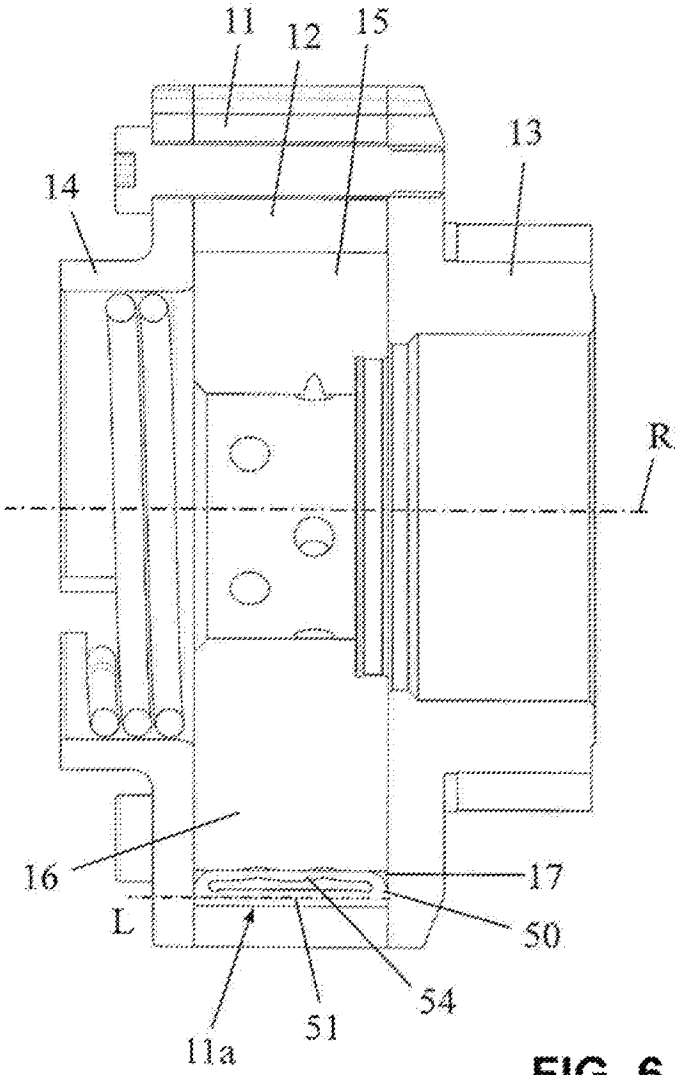
FIG. 6 a longitudinal section of the cam shaft phase setter.
Figure 5:
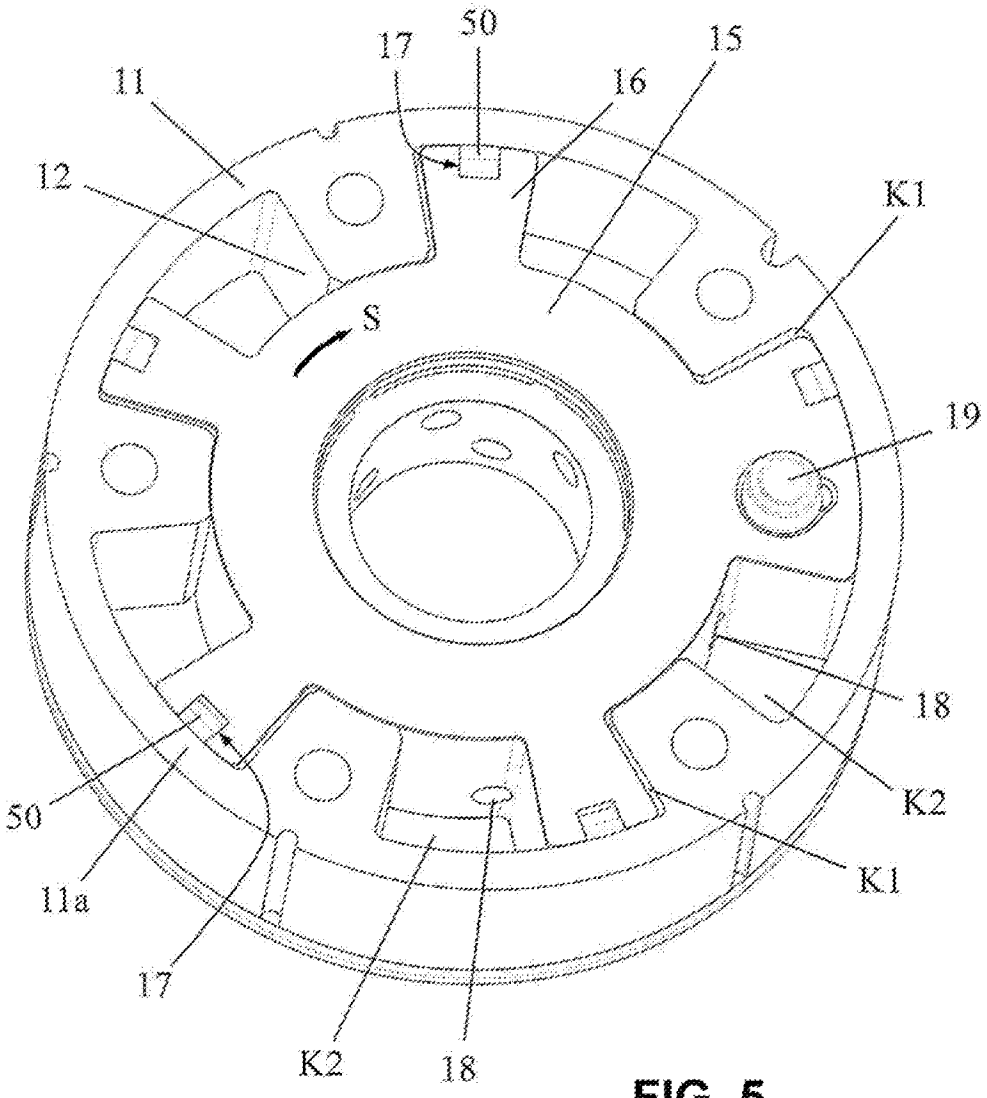
FIG. 5 an isometric representation of a stator-rotor arrangement of the cam shaft phase setter.

FIGS. 4 to 6 show a second example embodiment of a hydraulic device. The hydraulic device of the second example embodiment is a cam shaft phase setter for adjusting the phase position of a cam shaft of an internal combustion engine relative to a crankshaft of the internal combustion engine.

FIG. 4 shows an exploded representation of the cam shaft phase setter. The cam shaft phase setter is formed as a hydraulic swing-vane motor. The cam shaft phase setter comprises an actuating member 15 and a housing 11 which surrounds the actuating member 15. The housing 11 is closed off at one end-facing side by a housing cover 13 and at the opposing end-facing side by a housing cover 14. The actuating member 15 can be rotated back and forth in the housing arrangement 11, 13 and 14 about a rotational axis R within a certain rotational angular range and thus adjusted relative to the housing 11 and the housing covers 13 and 14 which are connected immovably to the housing 11. The housing or housing part 11 together with the housing covers 13 and 14 can also be referred to as the "housing" within the meaning of the invention.

When fitted on an internal combustion engine, the actuating member 15 is coupled to a cam shaft in a way which transmits torque. The cam shaft phase setter can in particular be arranged on an axial end of the cam shaft, and the actuating member 15 can be non-rotationally connected to the cam shaft. The housing arrangement 11, 13 and 14 is coupled to a crankshaft of the internal combustion engine in a way which transmits torque. The housing arrangement 11, 13 and 14 is coupled to the crankshaft in a way which is speed-resistant, i.e. invariant in terms of its rotational speed. The coupling can be formed as a toothed belt drive or chain drive or, as in the example embodiment, as a toothed wheel coupling. In the example embodiment, the housing cover 13 is provided with a drive wheel—in the example, a toothed wheel. In modifications, the drive wheel can instead also be provided on the outer circumference of the housing 11 or on the other housing cover 14. The housing 11 which is or can be coupled to the crankshaft in a way which is speed-resistant is usually referred to as the "stator", and the actuating member 15 which is or can be coupled to the cam shaft in a way which is speed-resistant is usually referred to as the "rotor".

FIG. 5 shows a perspective view of the arrangement consisting of the housing 11 and the actuating member 15, without the housing covers 13 and 14. The housing 11 forms an outer ring from which multiple jaws 12 protrude radially inwards. The actuating member 15 comprises a ring from which vanes 16 protrude radially outwards in the direction of an inner circumference of the housing 11. Each of the vanes 16 respectively protrudes radially between two adjacent jaws 12, such that the angular distances between the adjacent jaws 12 determine the maximum actuating path for the relative rotational adjustment of the actuating member 15. In FIG. 5, the actuating member 15 has assumed a rotational end position relative to the housing 11, from which it can be hydraulically adjusted in the actuating direction S, for example clockwise. The actuating member 15 can be hydraulically adjusted, selectively in the actuating direction S or in the actuating counter direction which is opposite to the actuating direction S. The two rotational end positions are predetermined by an abutting contact between at least one of the vanes 16 and one of the jaws 12.

In the circumferential direction, a pressure chamber K1 in the form of a leading chamber is formed between each of the vanes 16 and the next jaw 12 in the actuating counter direction, and another pressure chamber K2 in the form of a trailing chamber is formed with the respectively next jaw 12 in the actuating direction S. If the leading chambers K1 are pressurised using a hydraulic fluid, and the trailing chambers K2 are relieved of pressure, the actuating member 15 is adjusted in the actuating direction S, i.e. adjusted to lead, relative to the housing 11. If the trailing chambers K2 are pressurised using the hydraulic fluid, and the leading chambers K1 are relieved of pressure, the actuating member 15 is adjusted in the actuating counter direction.

The pressure chambers K1 and K2 each comprise an inlet 18 for the hydraulic fluid. Only the inlets 18 of the pressure chambers K2 can be seen in FIG. 5. The pressure chambers K1 comprise inlets 18 of the same type, which are hidden in FIG. 5 by the jaws 12, i.e. they emerge at a point below the jaws 12. The inlet 18 also simultaneously forms the outlet of the respective pressure chamber K1 and K2. In the example embodiment, a connecting channel extends at least substantially radially through the ring of the actuating member 15, starting from the respective inlet/outlet 18. The connecting channels emerge at an inner circumferential surface of the actuating member 15. The cam shaft phase setter includes a control valve which is arranged centrally in the actuating member 15, in order to selectively supply either the leading chambers K1 or the trailing chambers K2 with the hydraulic fluid, and to relieve the respectively other type of chamber of pressure, in accordance with control signals from an engine controller of the internal combustion engine. It is also selectively possible to close both groups of chambers K1 and K2 in order to hydraulically block the actuating member 15 in an intermediate position. Controlling a phase setter by means of a control valve, which can also be implemented in the phase setter of the invention, may be gathered for example from EP 2 365 193 B1.

In the end position assumed in FIG. 5, the actuating member 15 is locked relative to the housing 11. A torsionally stressed spring which can be seen in FIG. 6 rotates the actuating member 15 into the end position assumed in FIG. 5, when the pressure of the hydraulic fluid falls below a minimum pressure. In most practical applications, such as for example in motor vehicles, the actuating member 15 assumes this end position when the internal combustion engine is idling and in particular when it is not running. The lock is ensured by a locking pin 19 to which a spring force is applied in an axial direction and which latches into a depression in one of the two housing covers 13 and 14—in the example embodiment, the housing cover 13—which lies axially opposite in the end position, due to the effect of the spring force, when the end position is reached. Once the internal combustion engine has been started and a sufficient hydraulic pressure built up, and the hydraulic fluid is applied to the pressure chambers K1, the lock is released.

FIG. 6 shows a longitudinal section of the assembled cam shaft phase setter, likewise without the central control valve.

The pressure chambers K1 and K2 are sealed off at the end-facing sides of the actuating member 15, each in an axial sliding gap formed by the actuating member 15 and the respective housing cover 13 and 14. In order to radially seal off the pressure chambers K1 and K2, the housing 11 and the actuating member 15 form radial sliding gaps on the inner circumference of the jaws 12 and the outer circumference of the vanes 16. In order to improve the strength of seal, a sealing element 50 is arranged on the outer circumference of each vane 16. The sealing elements 50 and the radially opposing chamber wall structure 11*a* of the housing 11 respectively form a sealing gap. The chamber wall structures 11 a extend as annular segments between respectively adjacent jaws 12 of the housing 11. The sealing gaps formed by the sealing elements 50 seal the two pressure chambers K1 and K2, situated between adjacent jaws 12, from each other and thus ensure an improved fluidic separation between said adjacent chambers K1 and K2.

In the example embodiment, sealing elements are not provided on the inner circumferences of the jaws 12. In further developments, a sealing element—in particular, a sealing element of the type in accordance with the invention—can likewise be arranged on the inner circumference of each of the jaws 12 and form a sealing gap with the oppositely facing outer circumference of the actuating member 15. In such developments, the circumferential portions of the actuating member 15 which are situated between adjacent vanes 16 would form chamber wall structures within the meaning of the invention.

The sealing elements 50 are arranged in cavities 17. Each of the vanes 16 comprises a cavity 17 on its outer circumference. The cavities 17 each extend axially and continuously from one end-facing side of the actuating member 15 to the other end-facing side. The sealing elements 50 each press into the sealing contact with a spring force. The respective sealing element 50 is supported in its accommodating cavity 17, such that the spring force can be applied, and guided on the side walls of the cavity 17, which are mutually opposing in the circumferential direction, in the direction of the sealing contact and in the opposite direction.

In a comparable way to the sealing elements 20 of the hydraulic pump, the sealing elements 50 each comprise a sealing structure 51 and a spring structure 54 which are moulded in one piece. On a front side of the sealing element 50, the sealing structure 51 comprises a sealing surface via which the sealing element 50 is in sealing contact with the opposing chamber wall structure 11*a* of the housing 11. How the sealing elements 50 are arranged and operate can readily be seen from an overview of FIGS. 5 and 6. The spring structure 54 of the respective sealing element 50 is supported on the base of the accommodating cavity 17, and the sealing element 50 presses its sealing structure 51 into the sealing contact with a spring force. The sealing elements 50 are each installed with a spring biasing force.

The statements made with respect to the sealing elements 20 and cavities 7 of the hydraulic pump apply to the sealing elements 50, the cavities 17, and how the sealing elements 50 are supported, guided and installed with a spring biasing force.

Sealing elements are described below in different embodiments. Each of the sealing elements can substitute for the sealing elements 20 of the hydraulic pump and the sealing elements 50 of the cam shaft phase setter. Common to all the embodiments is that a sealing structure, which comprises a sealing surface for the sealing contact on a free front side of the respective sealing element, and a spring structure are moulded in one piece, and that the sealing element acts as a unit consisting of the sealing structure and the spring structure and can be handled and in particular fitted as a unit. The sealing elements are each designed to be installed in a cavity which can in particular correspond to the cavities 7 of the hydraulic pump or the cavities 17 of the cam shaft phase setter. The sealing elements are numbered consecutively in increments of ten. Structures and sub-structures having the same function are denoted by the same final digit, respectively. Thus, for example, the final digit "1" denotes the respective sealing structure, the final digit "2" denotes the sealing surface of the respective sealing structure, the final digit "3" denotes the guide, and the final digit "4" denotes the respective spring structure.

Figure 7:
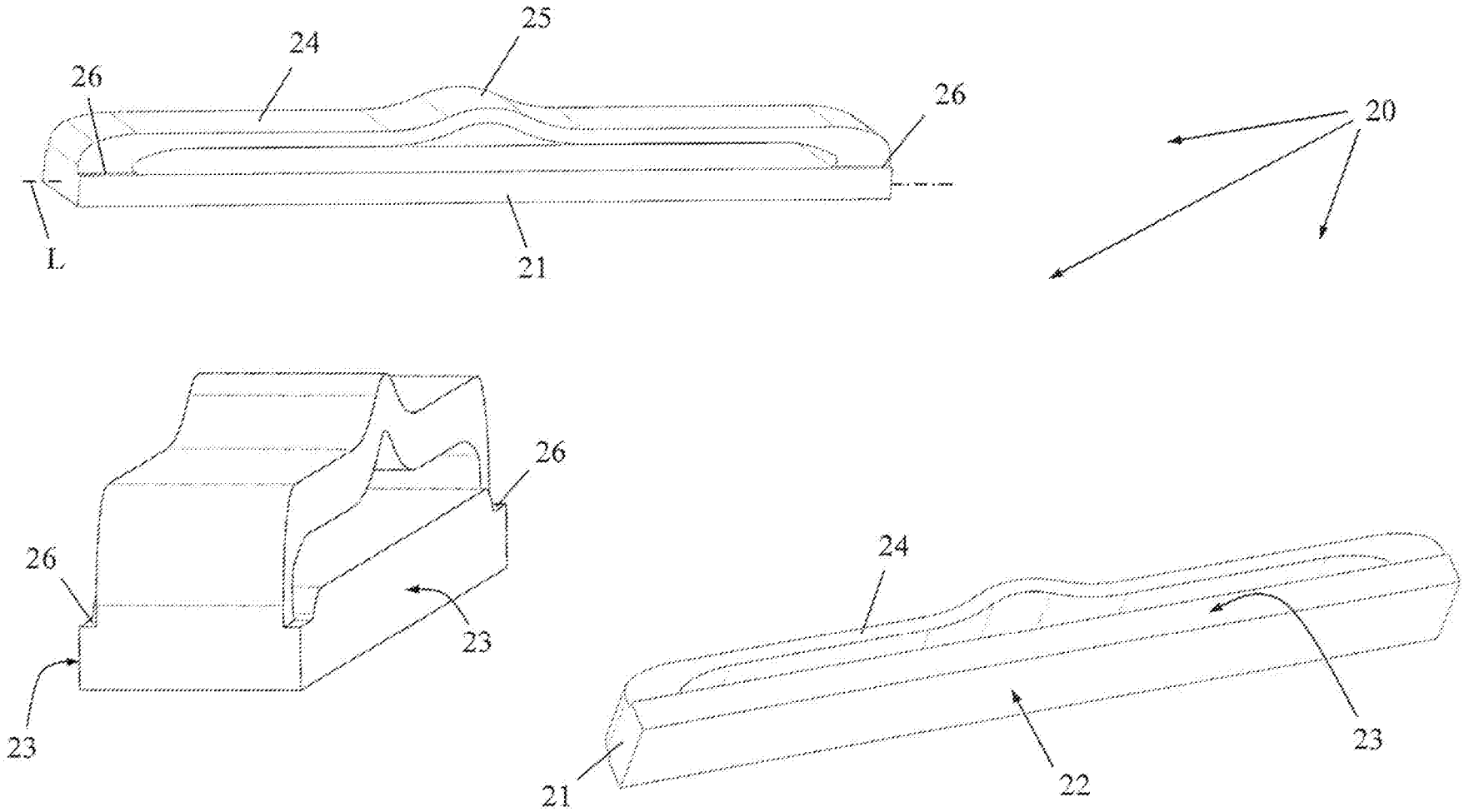
FIG. 7 a sealing element of a first example embodiment.

FIG. 7 shows the sealing element 20, described using the example of the hydraulic pump, in three isometric representations.

The sealing structure 21 is a slim sealing strip which extends in the longitudinal direction L. On a free front side, it comprises a sealing surface 22 for the sealing contact. The sealing surface 22 is planar. In modifications, it can however also be curved, in particular so as to conform to a sealing counter surface which may be curved. The sealing counter surface formed by the chamber wall structures 11*a* of the cam shaft phase setter is then for example curved concavely and, expediently, circularly in relation to the actuating member 15. For using the sealing element 20 in this way, the sealing surface 22 can be curved so as to conform to the sealing counter surface. A planar sealing surface 22 is advantageous with regard to production and in particular manufacturing costs. In modifications, the sealing surface 22 can be curved concavely inwards in relation to the sealing structure 21, i.e. in relation to the opposing sealing counter surface. A sealing surface 22 which is curved concavely in relation to the sealing counter surface, or a sealing surface 22 which is planar even though the sealing counter surface is concave, has only a linear contact, or a contact in one or two or even more narrow parallel strips, with the sealing counter surface. A linear contact or a contact in only one or more narrow strips can be set more precisely, as viewed over the entire length, than a sealing contact over a relatively larger area. In the running-in phase, the sliding partners—specifically, the sealing element 50 and the chamber wall structure 11*a* which co-operates with it; in the first example embodiment, the sealing element 20 and the chamber wall structure 1*a*—rub against each other until they conform, such that the surface of the sealing contact is increased but a defined sealing contact is still maintained or, if the sealing contact is over an area from the outset, is further improved.

The sealing structure 21 is beam-shaped. Its longitudinal sides comprise parallel lateral surfaces which form guides 23 for guiding in the accommodating cavity, for example one of the cavities 7 or 17. The guides 23 serve to guide the sealing structure 21 in the direction of the sealing contact and in the opposite direction. As already described, the accommodating cavity 7 or 17 comprises corresponding guiding counter surfaces in the form of its side walls.

The sealing structure 21 is resistant to deformation, in particular bending deformation, along its length as measured in the longitudinal direction L, in relation to the forces which act on it during operation, such that a uniform sealing contact is ensured over its entire length during operation.

On a rear side of the sealing structure 21, the spring structure 24 projects from the sealing structure 21 in a root region near each of the two axial ends and extends in the longitudinal direction L starting from the left-hand and left-hand root region. The spring structure 24 is shaped as a flat bracket or arc which extends from one axial end of the sealing structure 21 to the other axial end and is only connected to the sealing structure 21 near the axial ends of the sealing structure 21. The spring structure 24 is clear of the sealing structure 21 between the root regions which are short in comparison with the length of the sealing structure 21. The length of the clear region between the root regions is advantageously at least 50% or at least 70% or at least 80% of the axial length of the sealing structure 21.

For a sealing element itself, for example the sealing element 20, the word "axial" describes a position in relation to the longitudinal direction L or an extension in the longitudinal direction L. In advantageous embodiments, such as for example the example embodiments illustrated, the longitudinal direction L of the respective sealing element, when installed, is parallel to the rotational axis of a component of the hydraulic device—the delivery rotor 3 in the first example embodiment, and the actuating member 15 in the second example embodiment. In the example embodiments, the sealing elements are linear in the longitudinal direction L. In modifications, they can however also deviate from a linear profile in the longitudinal direction L, in a plan view onto the respective sealing surface, and exhibit a curvature or sweep. The use of the term "longitudinal direction" does not itself restrict the respective sealing element to a linear profile, although a profile which is continuously linear in the longitudinal direction is advantageous.

In a central region between the root regions, the spring structure 24 comprises a supporting region 25 which is curved concavely outwards away from the sealing structure 21 and via which the installed spring structure 24 is supported in the accommodating cavity 7 or 17. Instead of a supporting region 25 which is concave in relation to the sealing structure 21, the spring structure 24 can also comprise a cam or fin between the root regions which protrudes away from the sealing structure 21, in order to obtain a supporting region which is only local, i.e. shorter than the longitudinal extension of the spring structure 24. By providing the local supporting region 25 in the form of a bulge instead of a cam, fin or the like, it is advantageously possible to increase the spring path of the spring structure 24.

In order to generate the spring force, the spring structure 24 can be elastically deformed in a spring surface which follows the profile of the sealing structure 21 in the longitudinal direction L and extends at least substantially orthogonally with respect to the sealing surface 22. The sealing structure 21 overlaps the spring surface completely in a plan view onto the sealing surface 22. In the example embodiment, it also overlaps the spring structure 24 completely in the plan view. Because the profile of the sealing structure 21 is linear in the longitudinal direction, the spring surface in which the spring structure 24 can be spring-deflected is a spring plane, i.e. the spring surface is planar.

When installed, the spring structure 24 is primarily subjected to elastic bending stress, i.e. it acts as a flexible spring. The spring plane of the spring structure 24 extends in the longitudinal direction L of the sealing structure 21. In preferred embodiments, such as for example the example embodiments, the spring plane of the installed spring structure 24 extends orthogonally with respect to the actuating direction S of the respective actuating member, such as for example the actuating members 5 and 15 of the example embodiments. In principle, however, it would also be conceivable to position it obliquely with respect to the actuating direction S. In such modifications, the spring plane would however still extend parallel to the longitudinal extension of the accommodating cavity.

For applications in which the hydraulic fluid is applied to the rear side of the sealing structure 21 which faces oppositely away from the sealing surface 22, whereby the sealing structure 21 is to be pressed into the sealing contact with hydraulic assistance or primarily hydraulically, such as is for example the case in the hydraulic pump of the example embodiment, the spring structure 24 is narrower than the accommodating cavity, at least in regions. In the case of the sealing element 20, the spring structure 24 is slightly narrower than the sealing structure 21—and therefore also slightly narrower than the accommodating cavity, for example the cavity 7—over its entire length. The reduced breadth can clearly be seen in FIG. 7 in the root regions of the spring structure 24 in the form of a recess on each of the two sides of the sealing element 20. Due to the reduced breadth, an increase in pressure is propagated quickly and uniformly on the rear side over the entire length of the sealing structure 21.

The spring structure 24 is narrower than the sealing structure 21 over its entire length and over its height. In modifications, the spring structure 24 can also be recessed only in regions, in order to establish a fluid connection for the hydraulic fluid, for example in one or both root regions and/or in the supporting region 25 and/or in one or both spring portions which extend(s) in the longitudinal direction L between the supporting region 25 and one of the root regions, respectively. Instead of or in addition to one or more cavities, the fluid connection can also be provided by means of one or more passages which extend(s) through the spring structure 24.

Figure 8:
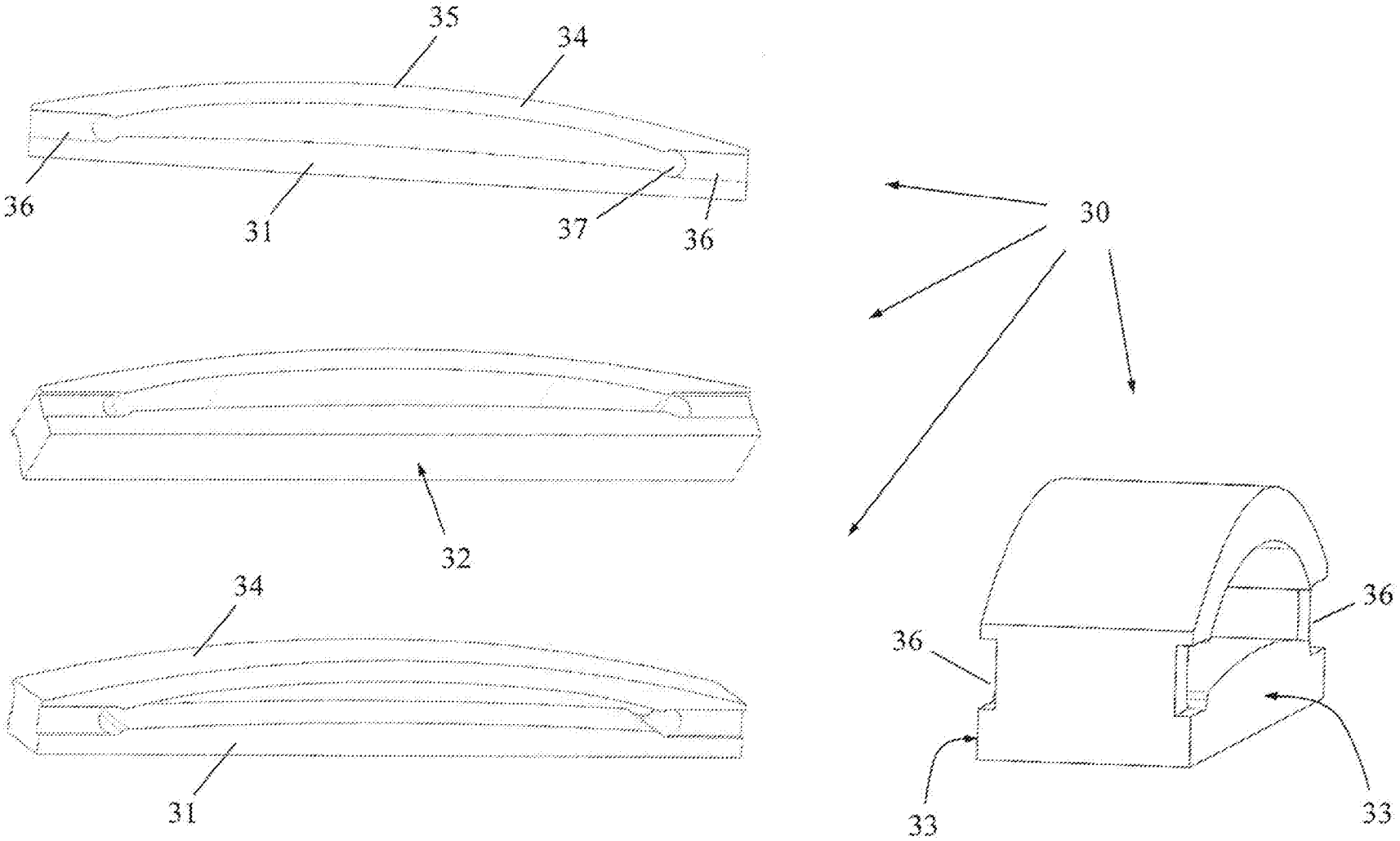
FIG. 8 a sealing element of a second example embodiment.

FIG. 8 shows a lateral view and three isometric representations of a sealing element 30 of a second example embodiment. The sealing element 30 comprises a sealing structure 31 and a spring structure 34 which are moulded in one piece. As in the first example embodiment, the spring structure 34 is shaped as a bracket or arc which extends from one root region at one end of the sealing structure 31 to a second root region at the other end of the sealing structure 31, as viewed in the longitudinal direction. Unlike the spring structure 24, the spring structure 34 is curved outwards away from the sealing structure 31, i.e. in a uniformly concave shape with respect to the sealing structure 31, between its root regions. The spring portion of the spring structure 34 which extends in the longitudinal direction is shaped as a simple arc. In the lateral view, the sealing element 30 is shaped like a flat "D". The middle portion of the arc, which exhibits the maximum distance from the sealing structure 31, forms the supporting region 35 of the sealing element 30. Since the supporting region 35 is derived from the arc shape, a shaped supporting element—comparable to the supporting region 25 of the first example embodiment—can be omitted.

In order to improve the spring characteristic of the spring structure 34, a clearance 37 in the form of a widening is provided for the arc portion at both axial ends, each in the root region.

Another difference with respect to the first example embodiment is how the hydraulic fluid feed to the rear side of the sealing structure 31 is embodied. To provide the feed, a cavity 36 is formed in the root regions of the spring structure 34 on each of the two sides, such that a fluid connection for the hydraulic fluid is obtained at the axial ends of the sealing element 30, on each of the two sides. Instead of just one or more local cavities 36, the spring structure 34 can be narrower than the sealing structure 31 over its entire length and height, as in the first example embodiment. As already mentioned with respect to the sealing element 20, a fluid connection can also be established by means of a passage through the spring structure 34, for example one or more bores. One or more cavities can also be implemented together with one or more passages.

Aside from the differences described, the statements with respect to the sealing element 20 of the first example embodiment apply similarly to the sealing element 30. Thus, as in the first example embodiment, the sides of the sealing structure 31 comprise parallel guides 33 which extend in the longitudinal direction, for linearly guiding in the direction of the sealing contact and in the opposite direction.

Figure 9:
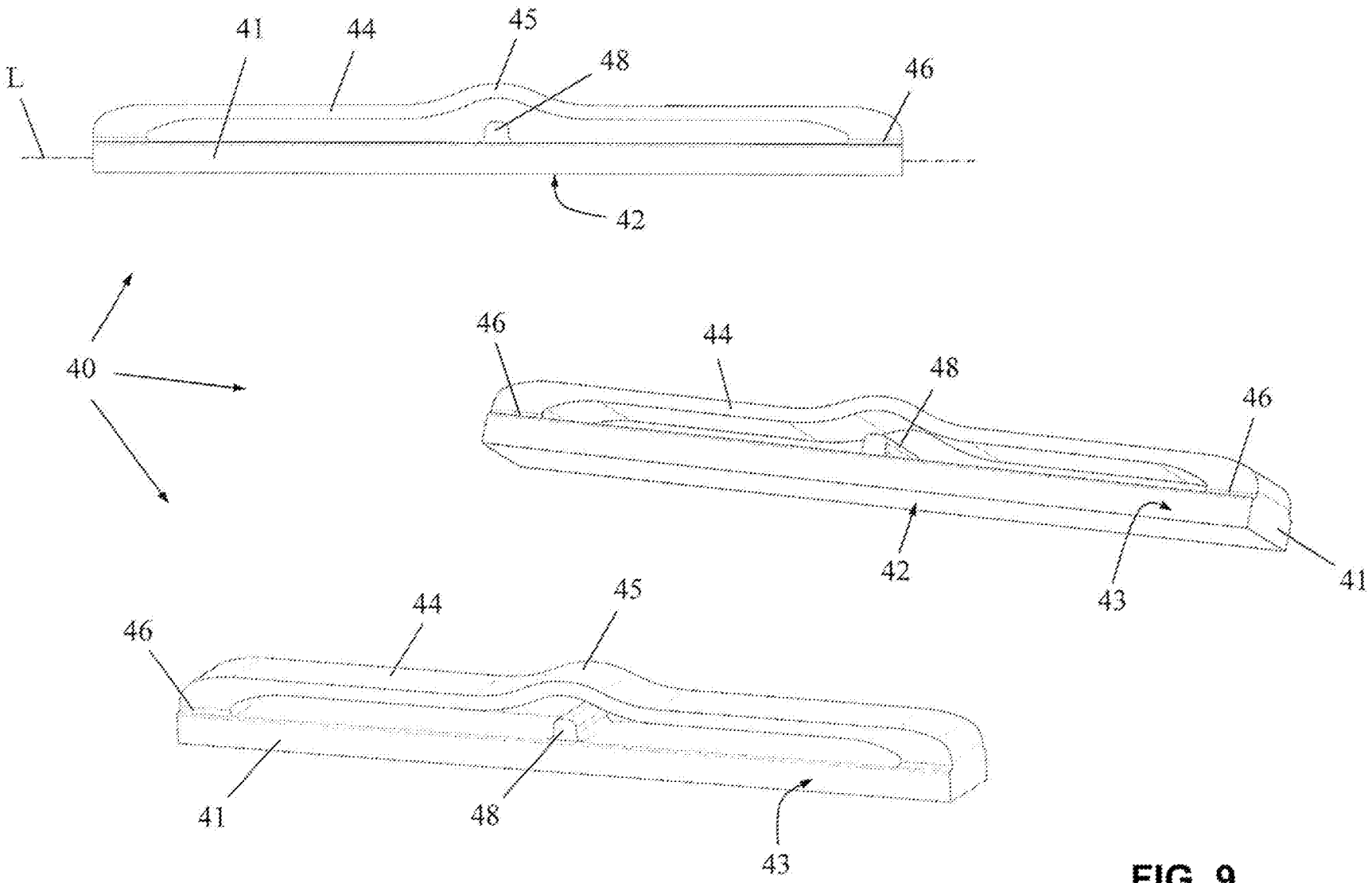
FIG. 9 a sealing element of a third example embodiment.

FIG. 9 shows a lateral view and two isometric representations of a sealing element 40 of a third example embodiment. The sealing element 40 differs from the sealing element 20 of the first example embodiment only in that it comprises a moulded abutment 48 which is moulded on the rear side of the sealing structure 41 such that it protrudes in the direction of the spring structure 44. The abutment 48 is axially arranged in the region of the bulged support 45—in the example embodiment, below the point of maximum bulge. The abutment 48 is moulded on the sealing structure 41 as a protruding fin. The abutment 48 limits the spring path of the spring structure 44 in order to predetermine a maximum possible deformation of the spring structure 44. By limiting the deformation, it is advantageously possible to prevent the sealing element 40 from becoming damaged while being handled, in particular when fitted in series production. In one modification, an abutment which is comparable to the abutment 48 can be moulded on the spring structure 44, rather than the sealing structure 41, such that it protrudes in the direction of the sealing structure 41. Following the taxonomy of the other example embodiments, the sealing surface is denoted as 42, the lateral guide for the sealing structure 41 is denoted as 43, and the fluid connection—in this case, in the form of a recess—is denoted as 46.

Figure 10:
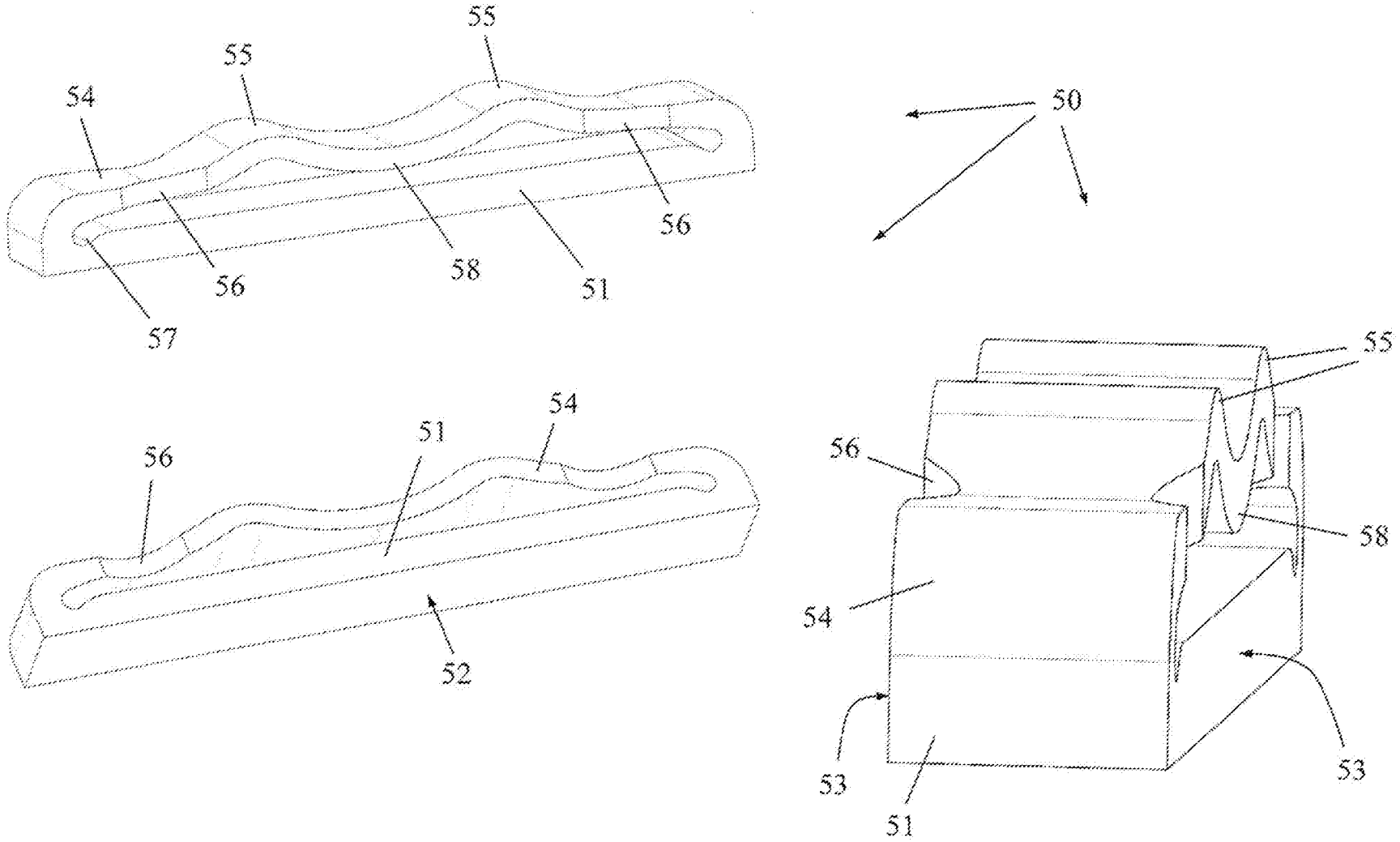
FIG. 10 a sealing element of a fourth example embodiment.

FIG. 10 shows three isometric representations of the sealing element 50, which has been described using the example of the cam shaft phase setter, as a fourth example embodiment. The sealing element 50 is derived from the sealing element 20 of the first example embodiment. Unlike the sealing element 20, it comprises: two supports 55, each in the form of a portion which is bulged concavely with respect to the sealing structure 51; a clearance 57, provided by a widening, in the spring structure 54 on each of the inner sides of the root regions; and an alternatively implemented hydraulic fluid feed 56. The feed 56 is formed by two troughed spring portions, each between one of the root regions and the nearest support 55. Another difference with respect to the first example embodiment is that an abutment 58 which is troughed convexly in relation to the sealing structure 51 is moulded between the supports 55. In a comparable way to the abutment 48 of the third example embodiment, the abutment 58 limits the maximum possible deformation of the spring structure 54 and therefore protects the sealing element 50 from becoming damaged due to deformation, in particular while the sealing element 50 is being fitted. The sealing surface is denoted as 52, and the lateral guides for the sealing structure 41 are denoted as 53. Aside from the differences described, the sealing element 50 corresponds to the sealing element 20 of the first example embodiment.

Figure 11:
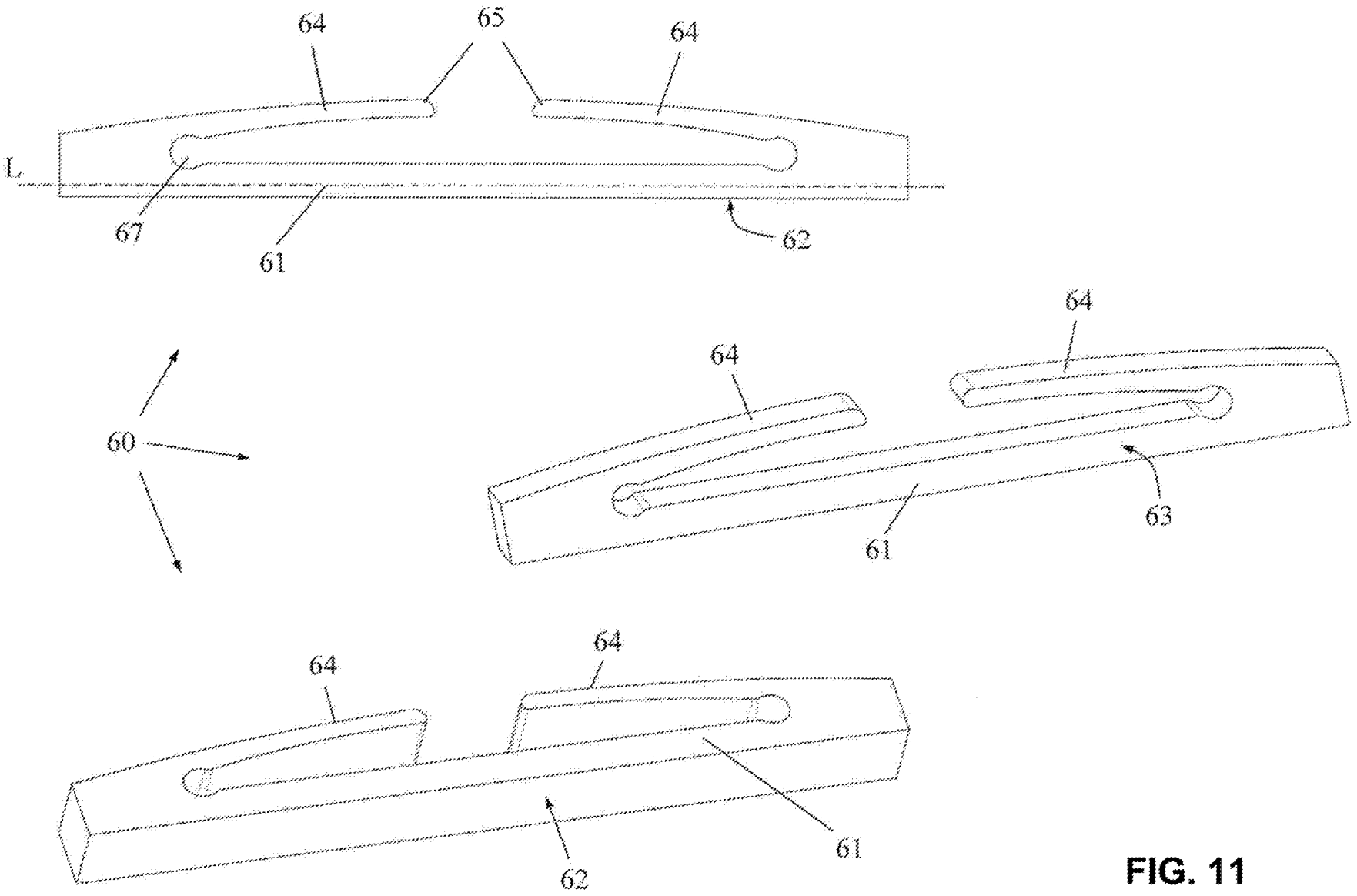
FIG. 11 a sealing element of a fifth example embodiment.

FIG. 11 shows a lateral view and two isometric representations of a sealing element 60 of a fifth example embodiment. Whereas the spring structures of the previous example embodiments extend along the respective sealing structure from a first root region to a second root region as a closed arc, for example as a simple arc as in the case of the sealing element 30 or as an arc which axially undulates one or more times as in the case of the sealing elements 20, 40 and 50, the sealing element 60 comprises a spring structure 64 featuring two spring portions which are arced concavely with respect to the sealing structure 61, each denoted as 64. The spring portions 64 protrude towards each other in the longitudinal direction L, each starting from a root region which is a root region which is an outer root region in the longitudinal extension, and at a clear distance from the sealing structure 61. Accordingly, their free ends point towards each other in the longitudinal direction L. The two spring portions 64 can be elastically bent, independently of each other, in the spring plane which extends in the longitudinal direction L. When installed, however, they are simultaneously subjected to bending stress, i.e. they jointly generate the spring force which acts on the sealing structure 61, due to the geometric conditions at the point of installation and due to the spring bias which is advantageously provided. It should also be noted that a spring portion clearance in the root region of the respective spring portion 64 is denoted as 67. The sealing surface is denoted as 62, the lateral guides for the sealing structure 61 are denoted as 63, and the supporting region at the free end of each spring portion 64 is denoted as 65.

The spring portions 64 can be elongated at each of their mutually opposing free ends by a portion which extends some way in the direction of the sealing structure 61. This can provide a defined abutment, for limiting the deformation, for each of the spring portions 64 in a comparable effect to the abutment 48 of the third example embodiment. Kinked ends, which are preferably bent roundly inwards towards the sealing structure 61, can in particular prevent the sealing element 60 from becoming hooked as it is being fitted. Limiting the deformation serves only to protect the sealing element from becoming unintentionally damaged as it is being fitted. An abutting function is implemented, as also elsewhere in all the other embodiments of the sealing element, such that an abutting contact is not made under the conditions which are to be expected during operation, but rather such that at least a minimum residual spring path always remains.

Figure 12:
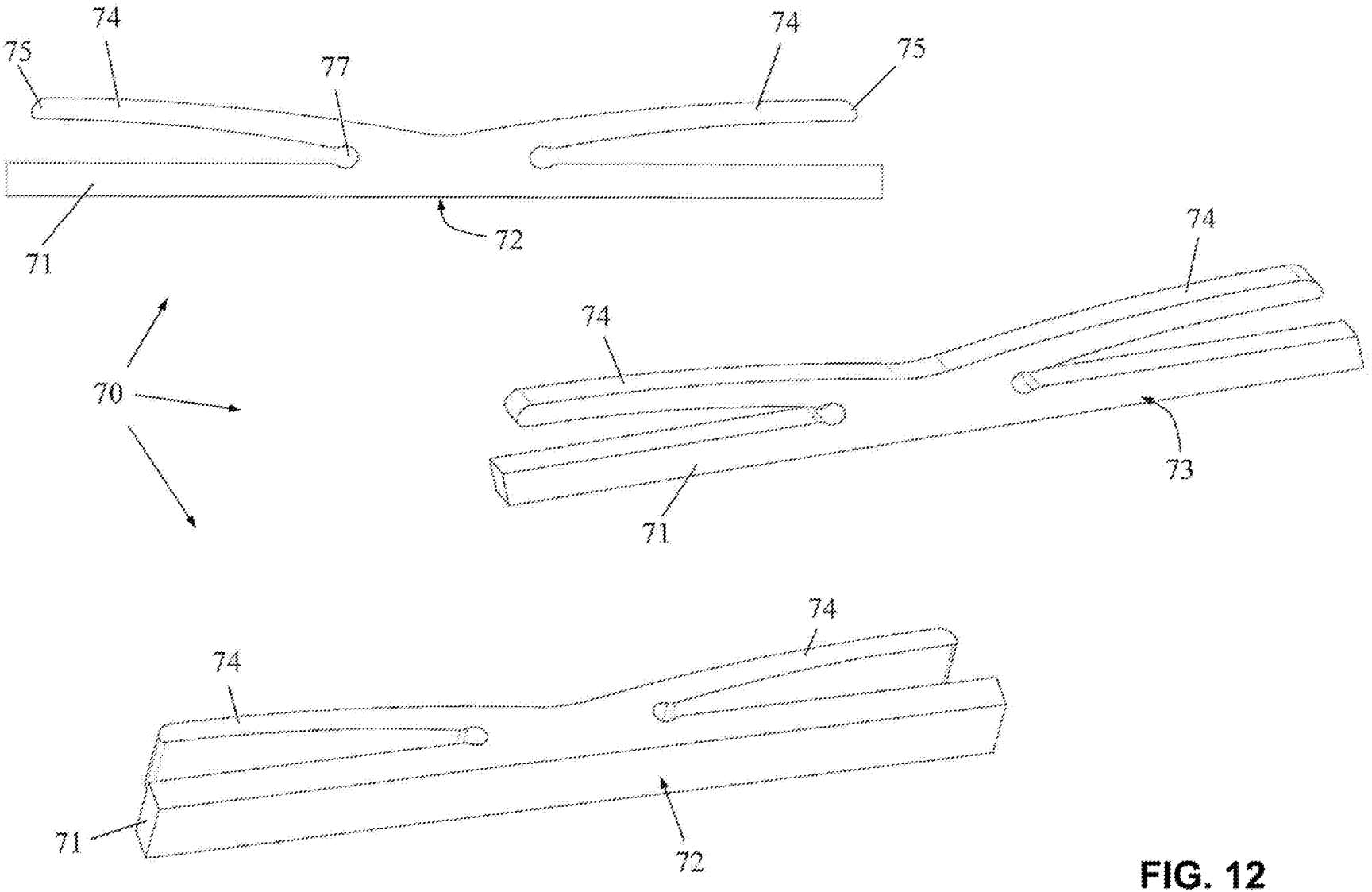
FIG. 12 a sealing element of a sixth example embodiment.

FIG. 12 shows a lateral view and two isometric representations of a sealing element 70 of a sixth example embodiment. Like the sealing element 60 of the preceding example embodiment, the sealing element 70 comprises two spring portions 74 which can be elastically deformed independently of each other. The spring portions 74 protrude on the rear side of the sealing structure 71 in the longitudinal direction L of the sealing element 70, but away from each other and from a root region which is a middle root region in the longitudinal extension. In the lateral view, the sealing element 70 is shaped like a flat "K". In order to improve the elastic bending characteristic of the spring portions 74, a clearance 77 is formed in the root region of the respective spring portion 74. The spring portions 74 spread outwards away from each other in the longitudinal direction L, forming a slightly concave curvature in the longitudinal direction L. The spring portions 74 could in principle also project in a uniformly oblique way or linearly in the lateral view. The sealing surface is denoted as 72, the lateral guide for the sealing structure 71 is denoted as 73, and the supporting region at the free end of each spring portion 74 is denoted as 75. The outer ends of the spring portions 74 can be elongated such that they kink inwards, preferably in a round bend, in order to limit the deformation at each of the two ends in a defined way.

Figure 13:
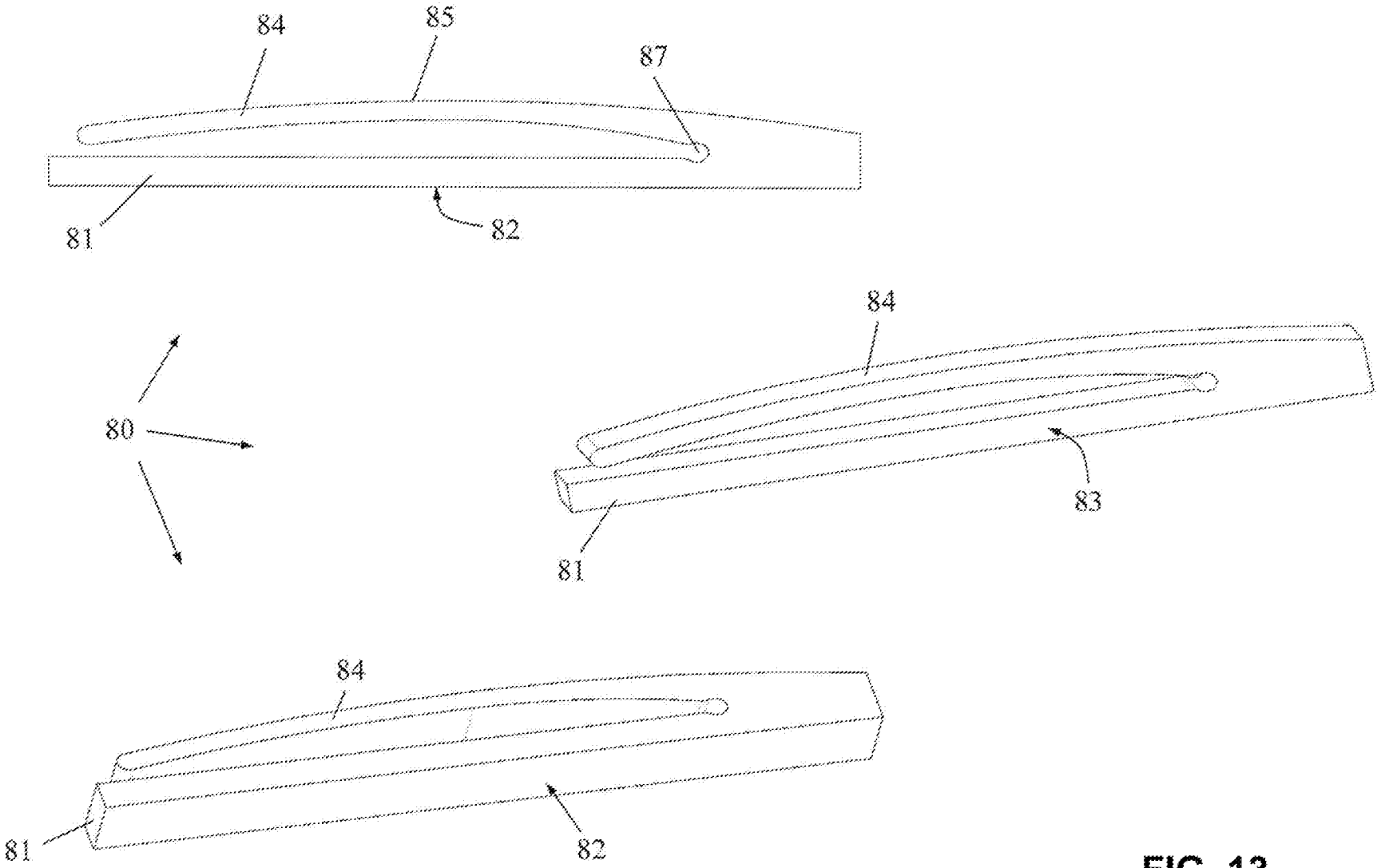
FIG. 13 a sealing element of a seventh example embodiment.

FIG. 13 shows a lateral view and two isometric representations of a sealing element 80 of a seventh example embodiment. The sealing element 80 substantially corresponds to the sealing element 30 of the second example embodiment. The spring structure 84 axially projects from an axial end region of the sealing structure 81 and describes an arc which is curved in a uniformly concave shape with respect to the sealing structure 81, starting from its root region, as in the second example embodiment. Unlike the second example embodiment, however, the arc comprises a free end which lies opposite the sealing structure 81 at a clear distance. A clearance 87 is again formed in the root region of the spring structure 84 in order to improve its spring characteristic. The sealing surface is denoted as 82, the lateral guides for the sealing structure 81 are denoted as 83, and the supporting region derived from the arc shape is denoted as 85. Due to its elongated concave shape, the spring structure 84 inherently forms an abutment at its free end, for protecting the sealing element from excessive deformation as it is being fitted.

If hydraulic fluid for applying pressure is introduced in specially provided fluid connections, such as for example the fluid connections 8 of the first example embodiment (FIG. 1), advantageous embodiments of such fluid connections would be configured such that the hydraulic fluid can directly flow into and flow off out of the region between the sealing structures 21.

One advantage of sealing elements comprising a freely protruding spring portion, such as the sealing elements 60, 70 and 80, is that tensile stresses are not introduced into the sealing structure when the sealing element is installed with a spring biasing force. The sealing structure of sealing elements comprising a freely protruding spring portion can be dimensioned to be slimmer than the sealing structure of sealing elements exhibiting a flow of force which is closed across the sealing structure. Conversely, self-contained sealing elements in which the flow of force is closed across the sealing structure, spring structure and root regions can be more easily handled in series production and in particular more easily separated. There is also no danger of them becoming hooked as they are inserted or introduced into the cavities.

Figure 14:
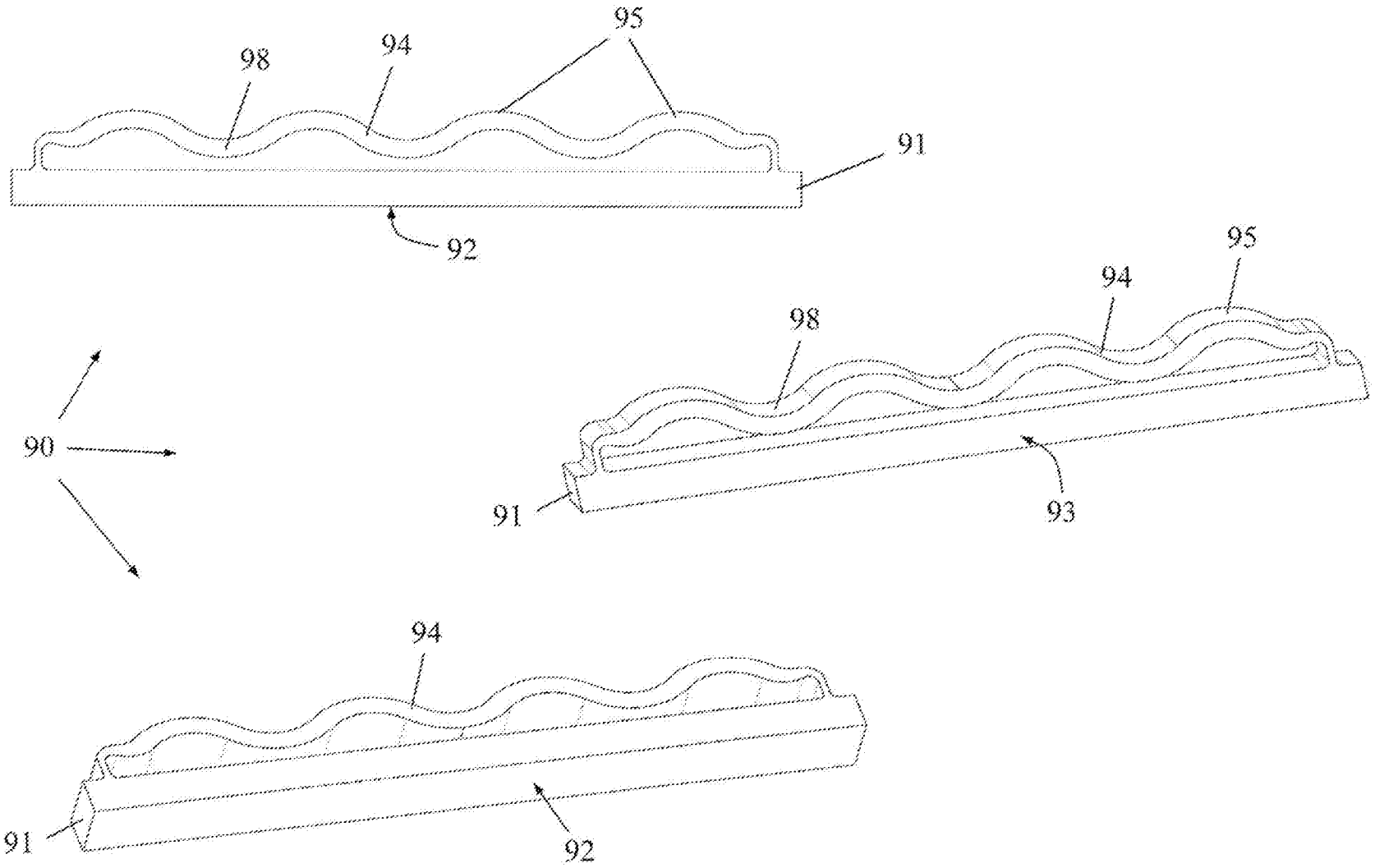
FIG. 14 a sealing element of an eighth example embodiment.

FIG. 14 shows a lateral view and two isometric representations of a sealing element 90 of an eighth example embodiment. The sealing element 90 is derived from the sealing elements 20 and 50 of the first and fourth example embodiments. Its spring structure 94 is connected to the sealing structure 91 near the two axial ends of the sealing structure 91, in each of the root regions, and forms an arc and/or bracket between the root regions which undulates multiple times in the longitudinal direction L. This provides supports 95 in spring portions of the spring structure 94 which are curved concavely with respect to the sealing structure 91, and abutments 98 in spring portions of the spring structure 94 which are curved convexly with respect to the sealing structure 91. The supports 95 serve to support the sealing element 90 in the accommodating cavity, and the abutments 98 limit the deformation and therefore in particular the danger of the sealing element becoming damaged as it is being fitted by an automatic assembly machine. The sealing surface is denoted as 92, and the lateral guides and/or side walls of the sealing structure 91, which is formed as a beam-shaped sealing strip as in the other example embodiments, are denoted as 93.

Figure 15:
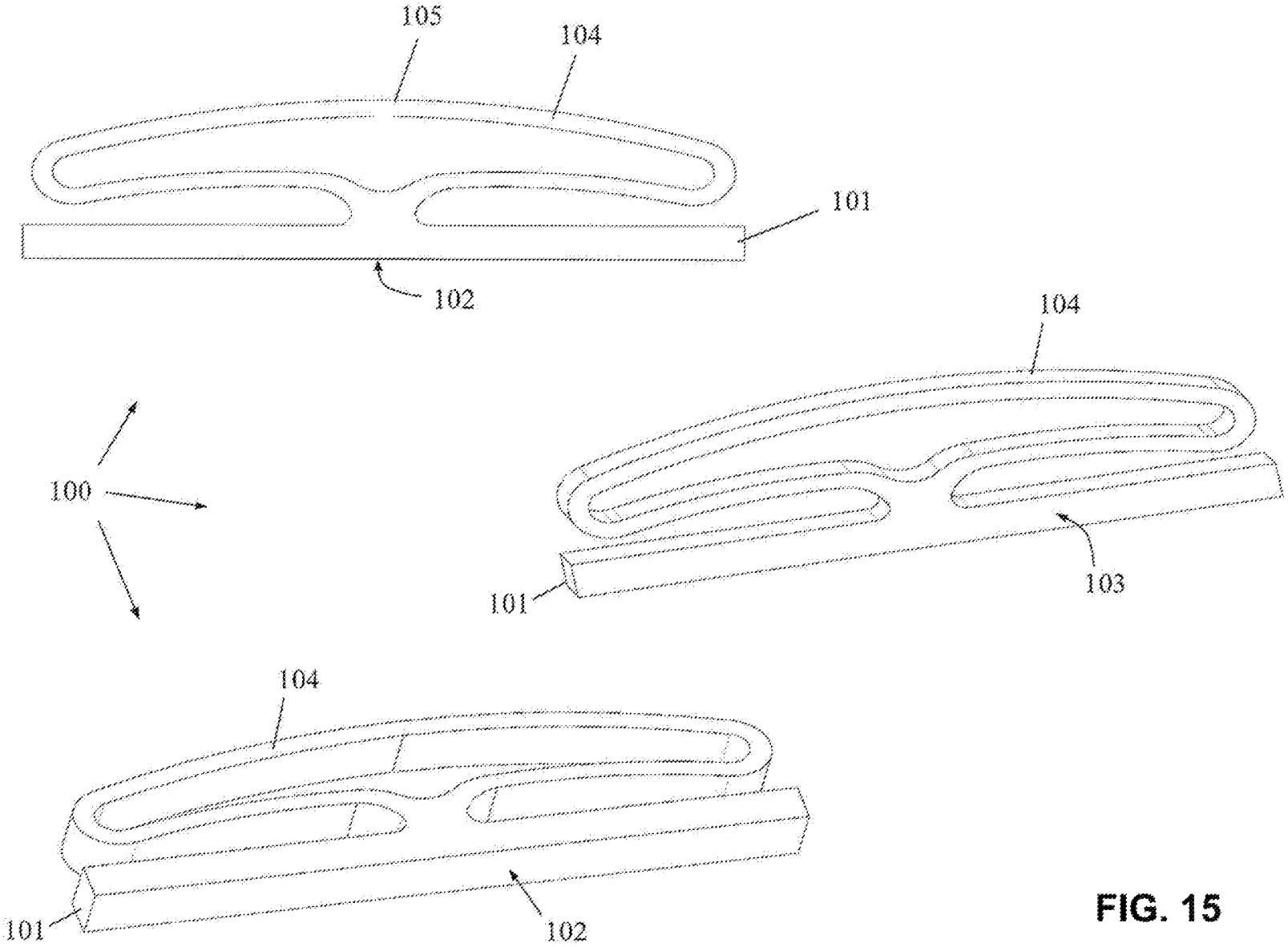
FIG. 15 a sealing element of a ninth example embodiment.

FIG. 15 shows a lateral view and two isometric representations of a sealing element 100 of a ninth example embodiment. Like the other sealing elements, the sealing element 100 comprises a sealing structure 101 in the form of a sealing strip comprising a sealing surface 102 and lateral guides 103, and a spring structure 104 which is moulded in one piece with the sealing structure 101. The spring structure 104 projects on the rear side of the sealing structure 101 in a root region, which in this case is an axially middle root region, and forms a spring ring which is flat in the lateral view and which comprises two inner spring portions, which project axially outwards from the root region, and an arc-shaped outer spring portion which also simultaneously forms the supporting region 105 and serves as a support in the accommodating cavity.

Figure 16:
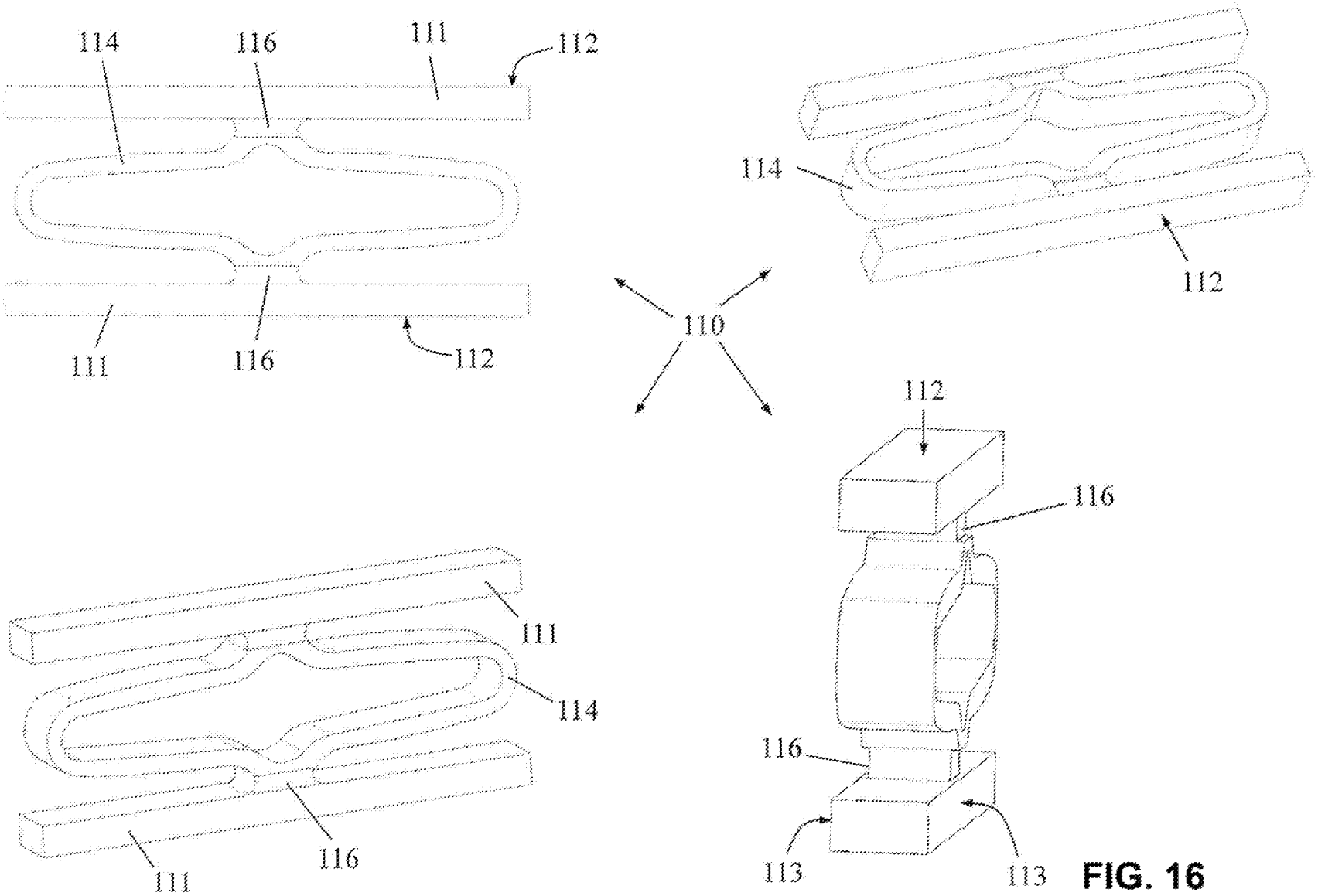
FIG. 16 a sealing element of a tenth example embodiment.

FIG. 16 shows a lateral view and three isometric representations of a sealing element 110 of a tenth example embodiment. The sealing element 110 comprises two identical sealing structures 111 and a spring structure 114 between the sealing structures 111. As in the other example embodiments, the sealing structures 111 and the spring structure 114 are moulded in one piece. Each of the sealing structures 111 can selectively form the sealing structure for the sealing contact, while the other sealing structure 111 in each case serves as a support in the accommodating cavity. This installation invariance of the sealing element 110 makes it easier to fit. With regard to being installed and/or fitted, the sealing element 110 is not only invariant against rotating by 180° about a central vertical axis of the sealing element 110 which points orthogonally with respect to the sealing surface 112, like the other sealing elements, but is also invariant in terms of rotating by 180° about a central longitudinal axis of the sealing element 110. The sealing element 110 is invariant against these two rotations not only for the practical purposes of being handled during fitting, but is also mirror-symmetrical in relation to a central plane of symmetry which is orthogonal with respect to the longitudinal axis and also mirror-symmetrical with respect to another central plane of symmetry which extends in the longitudinal direction L. In principle, however, exact mirror-symmetry is not required in relation to either one or other of the planes of symmetry in order to obtain the advantageous invariance in orientation for installation.

The two sealing structures 111 themselves are each formed as beam-shaped sealing strips which extend axially, as in the other example embodiments, although only one or other sealing strip selectively passes into the sealing contact, while the other one comes to rest in the accommodating cavity. When the sealing element 110 is installed, the spring structure 114 which is situated between the sealing structures 111 is subjected to bending stress, i.e. it acts as a flexible spring, in a spring plane which points orthogonally with respect to the actuating direction S, like the other spring structures. It is formed as a closed spring ring which is connected to and/or transitions into the sealing structures 111 in an axially middle region of the sealing element 110.

When the sealing element 110 is installed, one of the sealing structures 111 is situated in the sealing contact with the counter surface—the chamber wall structure 1*a* or 11*a* in the example embodiments—while the other of the two sealing structures 111 is accommodated in a cavity—the cavity 7 or 17 in the example embodiments—and serves to support the sealing element 110. The relevant sealing structure 111 thus forms a supporting structure in addition to the sealing structure 111, situated in the sealing contact, and the spring structure 114. Due to their symmetry, either of the two sealing structures 111 can selectively form the sealing contact, while the other in each case serves as the supporting structure.

Cavities which serve to feed the hydraulic fluid to the rear side of the sealing structure 111, which is situated in the sealing contact when the sealing element 110 is installed, are denoted as 116. In advantageous developments, the spring structure 114 can comprise one or more cavities and/or one or more passages in order to effect a rapid equalisation of pressure between the interior space surrounded by the annular spring structure 114 and the exterior space surrounding the spring structure 114. The lateral guides for the sealing structure 111 are denoted as 113.

Figure 17:
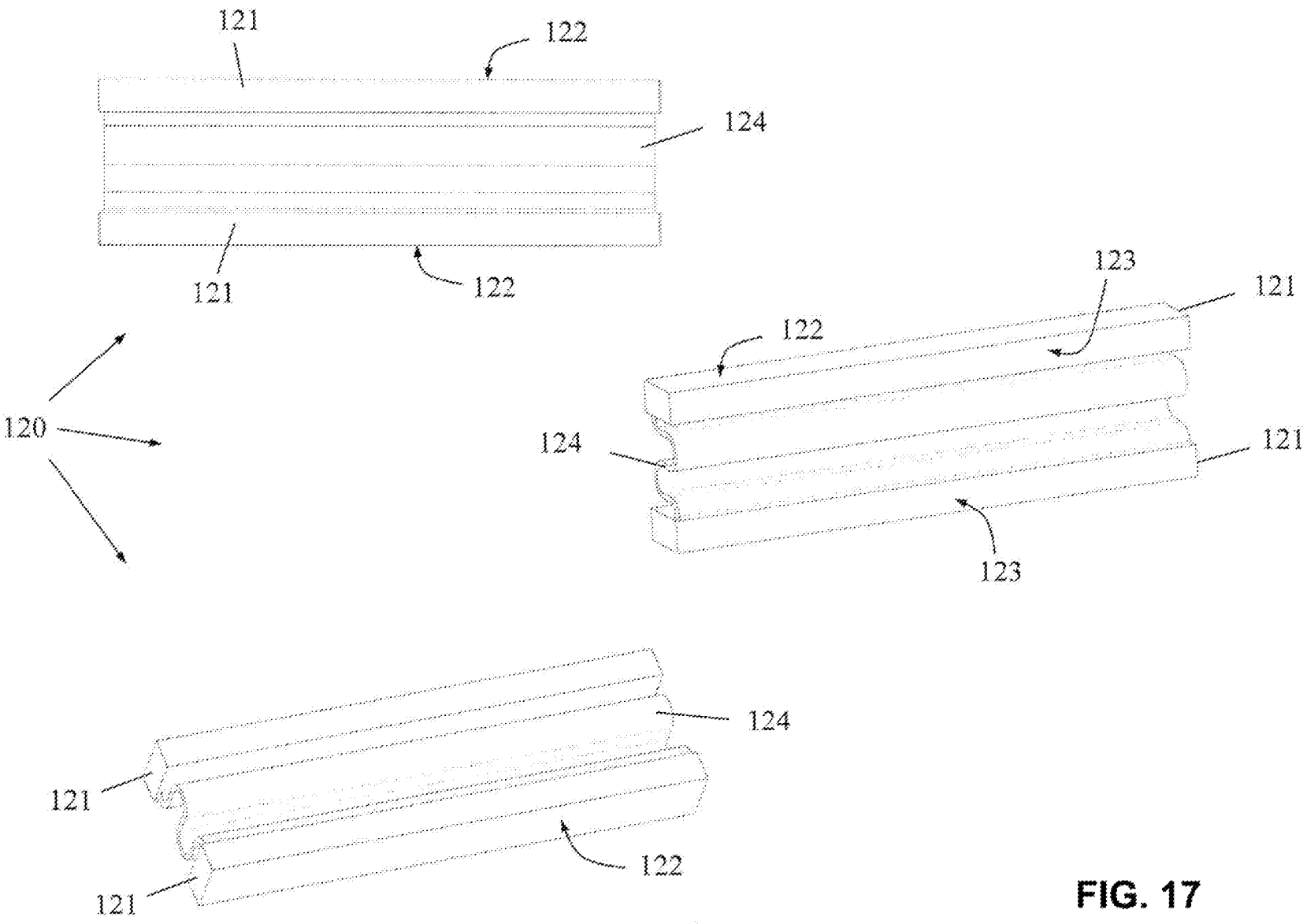

FIG. 17 shows a lateral view and two isometric representations of a sealing element 120 of an eleventh example embodiment. Like the sealing element 110 of the tenth example embodiment (FIG. 16), the sealing element 120 comprises two identical sealing structures 121 and a spring structure 124 which is arranged between the sealing structures 121. The sealing structures 121 and the spring structure 124 are moulded in one piece. Unlike the tenth example embodiment, the spring structure 124 undulates transversely. Following the taxonomy of the other example embodiments, the sealing surface is denoted as 122, and the lateral guide for the sealing structure 121 is denoted as 123.

The sealing elements of the example embodiments are produced from plastic. The sealing elements can consist of an elastomer material or can contain an elastomer material in particular regions, for example in order to achieve particular spring characteristics. Advantageously, however, the spring structures are elastic due to their shape and are in this sense dimensionally elastic, such that they can be moulded completely or at least predominantly from a thermoplastic material. Moulding them completely or at least predominantly from a thermoplastic material is preferred. The plastic sealing elements can in particular be manufactured in an injection-moulding method and thus provided as injection-moulded elements.

The respective sealing structure and the respective spring structure can consist of different plastic materials, in order to optimise the two structures for their respective functions. The material for the sealing structure can thus for example be chosen from the viewpoint of maximum possible wear resistance and/or low friction while still maintaining a good sealing characteristic, while the material for the spring structure is for example chosen with regard to minimum possible fatigue due to the constant spring movements. The sealing element can then be produced from two different plastic materials in a two-component injection-moulding method. It would also be conceivable, when using non-identical plastic materials and even when using the same material, to mould the sealing structure only or the spring structure only in a first method step and to mould the other structure in each case onto the already moulded structure in a subsequent method step, which can likewise be performed in an injection-moulding method by placing the already produced structure in the injection-moulding die and moulding the other structure onto it.

Sealing elements in accordance with the invention are designed to be used in hydraulic devices of the type described. Due to their geometry, they are suitable for continuous operation at working temperatures above 100° C. The choice of material is also relevant to their fitness for use. Through the configuration of its geometry and the choice of material, the sealing element is designed such that even towards the end of the service life for which it is designed, it still has sufficiently good spring characteristics, in order that it can perform its sealing function despite the working temperatures and varying loads which are to be expected during operation and the resultant relaxation of the material.

Suitable plastics are disclosed in the "aspects" section. In order to improve their mechanical characteristics, the plastics can contain a reinforcing material, for example glass fibres, or multiple different reinforcing materials. In order to improve its sliding characteristics, the respective plastic can contain one or more different sliding additives. One preferred additive is carbon fibre, since carbon fibres both increase the mechanical strength and positively influence the sliding characteristics. Alternatively or additionally, PTFE can also be added to the plastic as a sliding additive.

Particularly suitable original-moulding methods include generative moulding and casting methods. A 3D printing method can in particular be used for generatively moulding from plastic. In preferred embodiments, the two structures—the sealing structure and the spring structure—are moulded from the same plastic material in a combined method step, preferably in an injection-moulding method or generatively. If the sealing element comprises additional structures, such as for example the other sealing structure which can simultaneously serve as a supporting structure, then in the preferred embodiments, the sealing element comprising all its functional structures is moulded from the same plastic material in a combined method step, preferably in an injection-moulding method or generatively.

REFERENCE SIGNS

1 housing
1*a* chamber wall structure
1*b* housing cover
2 delivery chamber
3 delivery rotor
4 vane
5 actuating member
6 spring
7 cavity
8 connecting channel
9 supporting ring
10 inlet and outlet
11 housing, stator
11*a* chamber wall structure
12 jaw
13 housing cover
14 housing cover
15 actuating member, rotor
16 vane
17 cavity
18 inlet and outlet
19 latching pin
20 sealing element
21 sealing structure
22 sealing surface
23 guide
24 spring structure
25 supporting region
26 fluid connection (recess)
27-29 -
30 sealing element
31 sealing structure
32 sealing surface
33 guide
34 spring structure

35 supporting region
36 fluid connection (cavity)
37 clearance
38, 39 -
40 sealing element
41 sealing structure
42 sealing surface
43 guide
44 spring structure
45 support
46 fluid connection (recess)
47 -
48 abutment
49 -
50 sealing element
51 sealing structure
52 sealing surface
53 guide
54 spring structure
55 supporting region, support
56 fluid connection, feed (cavity)
57 clearance
58 abutment
59 -
60 sealing element
61 sealing structure
62 sealing surface
63 guide
64 spring structure, spring portion
65 supporting region
66 -
67 clearance
68, 69 -
70 sealing element
71 sealing structure
72 sealing surface
73 guide
74 spring structure, spring portion
75 supporting region
76 -
77 clearance
78, 79 -
80 sealing element
81 sealing structure
82 sealing surface
83 guide
84 spring structure
85 supporting region
86 -
87 clearance
88, 89 -
90 sealing element
91 sealing structure
92 sealing surface
93 guide
94 spring structure
95 support
96, 97 -
98 abutment
99 -
100 sealing element
101 sealing structure
102 sealing surface
103 guide
104 spring structure
105 supporting region
106-109 -
110 sealing element
111 sealing structure
112 sealing surface
113 guide
114 spring structure
115 -
116 fluid connection (cavity)
117-119 -
120 sealing element
121 sealing structure
122 sealing surface
123 guide
124 spring structure
I inlet
O outlet
R rotational axis
S actuating direction
K1 pressure chamber
K2 pressure chamber
L longitudinal axis

The invention claimed is:

1. A sealing element comprising:

(1) a sealing structure which exhibits a maximum extension in a longitudinal direction and comprises: a front side which extends in the longitudinal direction and comprises a sealing surface which forms a seal; and a rear side which extends in the longitudinal direction and faces oppositely away from the front side; and (2) a spring structure on the rear side of the sealing structure;

(3) wherein the spring structure is spring-deflectable in a direction of the rear side of the sealing structure, and (4) wherein the sealing structure and the spring structure are moulded in one piece;

(5) wherein the spring structure comprises a spring portion which extends at a distance from the rear side of the sealing structure and overlaps with the sealing structure in the longitudinal direction from a first end of the spring structure to a second end of the spring structure and protrudes from the sealing structure at the first and second end;

(6) wherein the spring structure alone or together with the sealing structure encompasses a free space into which the spring structure is spring-deflectable; and (7) wherein the spring structure is shaped as a flat bracket and in a central region between root regions, the spring structure comprises a local supporting region which is curved outwards away from the sealing structure in a form of a bulge, the spring structure having a radius of curvature which in the central region changes with respect to the sealing structure from negative to positive and back to negative thereby forming the bulge.

2. The sealing element according to claim 1, wherein the sealing structure and the spring structure are moulded generatively or in a casting method from plastic.

3. The sealing element according to claim 1, wherein the sealing structure and the spring structure consist of plastic, wherein the plastic contains one or more additives configured to improve a sliding characteristic of the plastic.

4. The sealing element according to claim 1, wherein the sealing structure is a beam-shaped or rod- shaped sealing strip and/or a sealing strip which is resistant to bending in a spring plane of the spring structure.

5. The sealing element according to claim 1, wherein the sealing structure has a solid profile which extends in the longitudinal direction or a hollow profile which is circumferentially closed.

6. The sealing element according to claim 1, wherein the spring structure is bent elastically, in the direction of the rear side of the sealing structure in a spring surface which extends in the longitudinal direction and follows a profile of the sealing structure.

7. The sealing element according to claim 1, (i) wherein the spring structure has a spring constant of at least 2 N/mm; and (ii) wherein the spring structure has a spring constant of at most 6 N/mm.

8. The sealing element according to claim 1, wherein the spring structure is configured to elastically deform in a spring plane by shifting a straight line in the longitudinal direction of the sealing structure in parallel, and wherein the spring portion extends at a distance from the rear side of the sealing structure and overlaps with the sealing structure in a spring surface.

9. The sealing element according to claim 1, wherein in a region of the spring structure the sealing element comprises a cavity and/or passage and/or is narrower than the sealing structure in an actuating direction throughout the sealing element.

10. The sealing element according to claim 1, wherein the sealing structure and the spring structure consist of a thermoplastic and/or thermosetting material, wherein the material contains reinforcing particles and/or a sliding additive configured to improve a sliding characteristic of the material.

11. A hydraulic device for an internal combustion engine or a gearing system, namely a hydraulic pump exhibiting an adjustable delivery volume, or a hydraulic cam shaft phase setter for adjusting a phase position of a cam shaft relative to a crankshaft of an internal combustion engine, the hydraulic device comprising:

(a) a housing including a chamber wall structure which delineates a pressure chamber for a pressurised hydraulic fluid;

(b) an actuating member which is configured to adjust in the housing relative to the chamber wall structure in an actuating direction and in an actuating counter direction which is opposite to the actuating direction so as to adjust the delivery volume or phase position;

(c) and a sealing element according to claim 1, wherein the spring structure is supported or moulded on one of the chamber wall structure and the actuating member and presses the sealing structure into a sealing contact with a remaining one of the chamber wall structure and the actuating member with a spring force so as to seal off the pressure chamber.

12. The hydraulic device according to claim 11, wherein the front side of the sealing structure is situated in the sealing contact, and the sealing structure and the spring structure extend from the front side of the sealing structure to the rear side of the sealing structure in a spring plane in which the spring structure is configured to elastically deform and which extends through the sealing contact and the rear side of the sealing structure.

13. The hydraulic device according to claim 11, wherein the spring structure is configured to elastically deform in a spring plane extending transverse to the actuating direction so as to generate the spring force.

14. The hydraulic device according to claim 11, wherein the spring structure is configured to elastically deform so as to be subjected to a spring biasing force which presses the sealing structure into the sealing contact in all positions which the actuating member assumes relative to the chamber wall structure when the hydraulic device is in operation.

15. The hydraulic device according to claim 11, wherein the rear side of the sealing structure is in fluid communication with the pressure chamber, such that the hydraulic fluid is applied to the rear side of the sealing structure in a direction of the sealing contact.

16. The hydraulic device according to claim 11, wherein the sealing element is arranged in a cavity of one of the chamber wall structure and the actuating member, and the cavity comprises side walls which face each other in the actuating direction and guide the sealing structure such that the sealing structure is moved in a direction of the sealing contact.

17. The hydraulic device according claim 11, wherein the sealing element is arranged in a cavity of one of the chamber wall structure and the actuating member, and the front side of the sealing structure comprises a sealing surface which is in the sealing contact with the chamber wall structure, and the rear side of the sealing structure locally comprises a supporting region via which the sealing element is supported in the cavity by a pressure contact.

18. The hydraulic device according to claim 11, wherein: the hydraulic device further comprises a rotor which rotates about a rotational axis; the actuating member surrounds the rotor or forms the rotor and comprises a circumference which extends around the rotational axis and lies opposite the chamber wall structure in a region of a sealing gap; and the sealing gap and the sealing element extend in a direction which comprises an axial directional component which is parallel to the rotational axis.

19. A sealing element comprising:

(1) a sealing structure which exhibits a maximum extension in a longitudinal direction and comprises: a front side which extends in the longitudinal direction and comprises a sealing surface which forms a seal; and a rear side which extends in the longitudinal direction and faces oppositely away from the front side; and (2) a spring structure on the rear side of the sealing structure;

(3) wherein the spring structure is spring-deflectable in a direction of the rear side of the sealing structure, and (4) wherein the sealing structure and the spring structure are moulded in one piece;

(5) wherein the spring structure comprises a spring portion which extends at a distance from the rear side of the sealing structure and overlaps with the sealing structure in the longitudinal direction from a first end of the spring structure to a second end of the spring structure and protrudes from the sealing structure at the first and second end;

(6) wherein the spring structure alone or together with the sealing structure encompasses a free space into which the spring structure is spring-deflectable; and (7) wherein the spring structure extends along a respective sealing structure from a first root region of the spring structure to a second root region of the spring structure as an arc which axially undulates a plurality of times providing supports, each in a form of a portion which is bulged away from the sealing structure.

* * * * *